US008697160B2

(12) United States Patent
Becraft et al.

(10) Patent No.: US 8,697,160 B2
(45) Date of Patent: Apr. 15, 2014

(54) SUSPENSION PACKAGING WITH ON-DEMAND OXYGEN EXPOSURE

(75) Inventors: Michael Lee Becraft, Greer, SC (US); Joseph E. Owensby, Spartanburg, SC (US); Blake Coates, Lyman, SC (US); Donald Keith Moore, Jr., Spartanburg, SC (US); Slawomir Opuszko, Duncan, SC (US); James A. Mize, Simpsonville, SC (US); Eugenio Longo, Milan (IT)

(73) Assignee: Cryovac, Inc., Duncan, SC (US)

( * ) Notice: Subject to any disclaimer, the term of this patent is extended or adjusted under 35 U.S.C. 154(b) by 491 days.

(21) Appl. No.: 12/587,370

(22) Filed: Oct. 6, 2009

(65) Prior Publication Data

US 2011/0081460 A1 Apr. 7, 2011

(51) Int. Cl.
*B65B 25/06* (2006.01)

(52) U.S. Cl.
USPC ..... 426/129; 426/125; 426/398

(58) Field of Classification Search
CPC ..... B65D 81/075; B65D 81/24; B65D 75/38; B65D 81/203; B65D 81/2023
USPC ..... 426/118, 125, 129, 398
See application file for complete search history.

(56) References Cited

U.S. PATENT DOCUMENTS

| | | | | |
|---|---|---|---|---|
| 1,220,670 | A | | 3/1917 | Milliron |
| 2,993,587 | A | | 7/1961 | Doran et al. |
| 3,523,863 | A | | 8/1970 | Juhos |
| 3,574,642 | A | | 4/1971 | Weinke |
| 3,681,092 | A | * | 8/1972 | Titchenal et al. ..... 426/412 |
| 3,778,515 | A | | 12/1973 | Ashley |
| 3,804,965 | A | * | 4/1974 | Peters ..... 426/523 |
| 4,055,672 | A | | 10/1977 | Hirsch et al. |
| 4,886,690 | A | * | 12/1989 | Davis et al. ..... 428/36.6 |
| 4,910,033 | A | * | 3/1990 | Bekele et al. ..... 426/129 |
| 4,949,530 | A | | 8/1990 | Pharo |
| 5,218,510 | A | | 6/1993 | Bradford |
| 5,560,182 | A | | 10/1996 | Garwood |
| 5,741,535 | A | | 4/1998 | Cope et al. |
| 5,762,200 | A | | 6/1998 | Goudreau |
| 5,769,235 | A | | 6/1998 | Keach et al. |
| 6,796,423 | B2 | | 9/2004 | Miller |
| 6,889,839 | B1 | | 5/2005 | Rosten et al. |
| 7,007,444 | B2 | | 3/2006 | Miller |
| 7,141,256 | B2 | | 11/2006 | Noel et al. |
| 7,147,106 | B2 | | 12/2006 | Kowalski et al. |
| 7,316,318 | B1 | | 1/2008 | Rosten et al. |

* cited by examiner

*Primary Examiner* — Rena L Dye
*Assistant Examiner* — Chaim Smith
(74) *Attorney, Agent, or Firm* — Ashley D. Wilson

(57) ABSTRACT

The presently disclosed subject matter is directed to an article that enables on-demand blooming of an oxygen-sensitive product packaged within the interior of the article. Specifically, the product can be packaged between two films, wherein at least one of the films is oxygen-permeable. The edges of the films can be attached to one or more suspension frames, such that the product is suspended between the two frames. The oxygen-impermeable film is covered in with an oxygen-impermeable material that can be removed on demand to promote blooming.

20 Claims, 25 Drawing Sheets

SUSPENSION PACKAGING WITH ON-DEMAND OXYGEN EXPOSURE

BACKGROUND

Most fresh red meat, fish, and poultry products sold in retail markets are packaged in trays formed from wood fibers, paperboard, plastic foam, or thermoformed plastic sheet material. The trays are not transparent and therefore cover and obscure the consumer's view of the packaged product. Attempts have been made to provide transparent windows in the tray, but the windows typically expose only a minor amount of the product. Even where transparent film would otherwise have exposed one side of the product, printed indicia, labels, and the like have prevented an uninterrupted view of the packaged product.

Another major disadvantage of prior packaging of meat products is that such packaging has almost universally been of irregular size and shape. Because of the irregular shape and size, packages currently in use are difficult to stack and display. Indeed, the shapes of such prior packaging require that such packages be displayed in horizontal display cases. These refrigerated cases are inefficient, costly, and difficult for consumers to access. Thus, both producers and consumers prefer packages of uniform shape and size that are much easier to pack and inventory.

Accordingly, it is an object of the presently disclosed subject matter to provide a unique article that does not obscure the customer's view of the packaged product and that is capable of stacking.

Meat color is also an important characteristic of packaged meat products that affects merchantability. Particularly, consumers often use color as an indicator of meat quality and freshness. The color of meat is related to the amount and chemical state of myoglobin therein. Myoglobin is present in the muscle tissue of all animals and functions to store and deliver oxygen by reversibly binding molecular oxygen, thereby creating an intracellular source of oxygen for the mitochondria. Pork and poultry typically contain lower amounts of myoglobin compared to beef and thus are lighter in color.

Myoglobin includes an open binding site called "heme" that can bind certain small molecules, such as molecular oxygen or water. Particularly, the color of a meat product changes based on the amount of myoglobin present and the amount and type(s) of ligand molecule(s) bound to the heme binding site. For example, myoglobin without a molecule bound to the heme site results in a purple-colored molecule called deoxymyoglobin. Further, when oxygen binds to the heme pocket, purple deoxymyoglobin becomes oxymyoglobin, characterized by a red color. In addition, when a water molecule binds to the heme site, the myoglobin molecule turns brown and is referred to as metmyoglobin.

In packaging of fresh red meat products, it is common practice to initially cut and package the meat at a processing facility for subsequent shipment to retail outlets. If meat products are packaged such that ambient air is contained within the article, meat discoloration can result, caused by the conversion of myoglobin to a grayish or brownish metmyoglobin. The discoloration generally renders the meat product unacceptable for consumers. In addition, such exposure to ambient air can ultimately result in spoilage of the meat. To overcome the discoloration problem, meat can be contained in a modified atmosphere package ("MAP"), wherein gases with little or no oxygen are used in the package headspace. Low oxygen MAP results in meat with a purple color due to myoglobin reducing to deoxymyoglobin.

In the past, the goal of central fresh red meat processing has not been achievable because most consumers prefer to buy meat that is reddened in color ("bloomed") as a result of exposure to oxygen. However, the meat maintains its reddened color for approximately one to three days and, thereafter, turns a brown color which is undesirable to most consumers.

Accordingly, in some embodiments, it is an object of the presently disclosed subject matter to provide an article that allows for blooming at a desired time.

SUMMARY

In some embodiments, the presently disclosed subject matter is directed to an article that enables on-demand blooming of an oxygen-sensitive product within the interior of the article. The article comprises a product packaged between upper and lower films, wherein at least one of the upper and lower films is oxygen-permeable. In some embodiments, the article comprises upper and lower oxygen-impermeable suspension frames, wherein each frame comprises a plurality of upright side panels, and wherein the edges of the films are maintained in between the upper and lower frames. In some embodiments, the article comprises a single oxygen-impermeable suspension frame, wherein the frame comprises a plurality of upright side panels, and wherein the edges of the upper and lower films are attached to the frame. The article further comprises an oxygen-impermeable material covering the at least one oxygen-permeable film, wherein the oxygen-impermeable material can be removed on demand to enable blooming of the oxygen-sensitive product.

In some embodiments, the presently disclosed subject matter is directed to a method of packaging an oxygen-sensitive product in an article that enables on-demand blooming within the interior of the article. The method comprises providing an oxygen-sensitive product and packaging the product between upper and lower films, wherein at least one of the upper and lower films is oxygen-permeable. In some embodiments, the method comprises maintaining the edges of the upper and lower films between upper and lower oxygen-impermeable suspension frames, wherein each frame comprises a plurality of upright side panels. In some embodiments, the method comprises attaching the edges of the upper and lower films to a single oxygen-impermeable suspension frame, wherein the frame comprises a plurality of upright side panels. The method further comprises covering the oxygen-permeable film with an oxygen-impermeable material, wherein the oxygen-impermeable material can be removed on demand to enable blooming within the interior of the article.

In some embodiments, the presently disclosed subject matter is directed to a method of promoting on-demand blooming of an oxygen-sensitive product. The method comprises providing an oxygen-sensitive product and packaging the product between upper and lower films, wherein at least one of the upper and lower films is oxygen-permeable. In some embodiments, the method comprises maintaining the edges of the upper and lower films between upper and lower oxygen-impermeable suspension frames, wherein each frame comprises a plurality of upright side panels. In some embodiments, the method comprises attaching the edges of the upper and lower films to a single oxygen-impermeable suspension frame, wherein the frame comprises a plurality of upright side panels. The method further comprises covering the oxygen-permeable film with an oxygen-impermeable material wherein the oxygen-impermeable material can be removed on demand to promote blooming of the oxygen-sensitive product.

In some embodiments, the presently disclosed subject matter is directed to a method of promoting on-demand blooming of an oxygen-sensitive product. The method comprises packaging the oxygen-sensitive product in an article by providing an oxygen-sensitive product, packaging the product between upper and lower films, wherein at least one of the upper and lower films is oxygen-permeable, and either maintaining the edges of the films between upper and lower oxygen-impermeable suspension frames or attaching the edges of the films to a single oxygen-impermeable suspension frame. The method further comprises stacking a plurality of articles for a desired time, covering the oxygen-permeable film with an oxygen-impermeable material, and promoting blooming of the oxygen-sensitive product by either removing the oxygen-impermeable material, removing an article from the stack, or both removing the oxygen-impermeable material and removing an article from the stack.

In some embodiments, the presently disclosed subject matter is directed to an article that enables on-demand exposure of a product to a gas or liquid, the article comprising: a product packaged between upper and lower films, wherein at least one of the films is permeable to the gas or liquid. The article also comprises either upper and lower suspension frames, wherein each frame is impermeable to the gas or liquid, wherein each frame comprises a plurality of upright side panels, and wherein the edges of the films are maintained in between the upper and lower frames; or a single suspension frame, wherein the frame is impermeable to the gas or liquid, wherein the frame comprises a plurality of upright side panels, and wherein the edges of the films are attached to the frame. The article also comprises a material covering the at least one permeable film, wherein the material is impermeable to the gas or liquid, wherein the material can be removed on demand to enable exposure of the product to the gas or liquid.

In some embodiments, the presently disclosed subject matter is directed to a method of promoting on demand exposure of a product to a gas or liquid. The method comprises the steps of: providing a product and packaging the product between upper and lower films, wherein at least one of the films is permeable to the gas or liquid. The method also comprises either maintaining the edges of the films between upper and lower suspension frames, wherein each frame comprises a plurality of upright side panels, wherein the edges of the films are maintained in between the upper and lower frames, and wherein each frame is impermeable to the gas; or attaching the edges of the films to a single suspension frame, wherein the frame is impermeable to the gas or liquid, wherein the frame comprises a plurality of upright side panels, and wherein the edges of the films are attached to the frame. The method also comprises covering the permeable film with a material, wherein the material is impermeable to the gas or liquid and removing the impermeable material at a desired time to promote exposure of the product to the gas or liquid.

DETAILED DESCRIPTION

I. General Considerations

The presently disclosed subject matter will now be described more fully hereinafter with reference to the accompanying drawings, in which some (but not all) embodiments are shown. Indeed, the presently disclosed subject matter can be embodied in many different forms and should not be construed as limited to the embodiments set forth herein. Rather, the embodiments set forth below are provided to satisfy applicable legal requirements. Like numbers refer to like elements throughout.

Figure 1A:
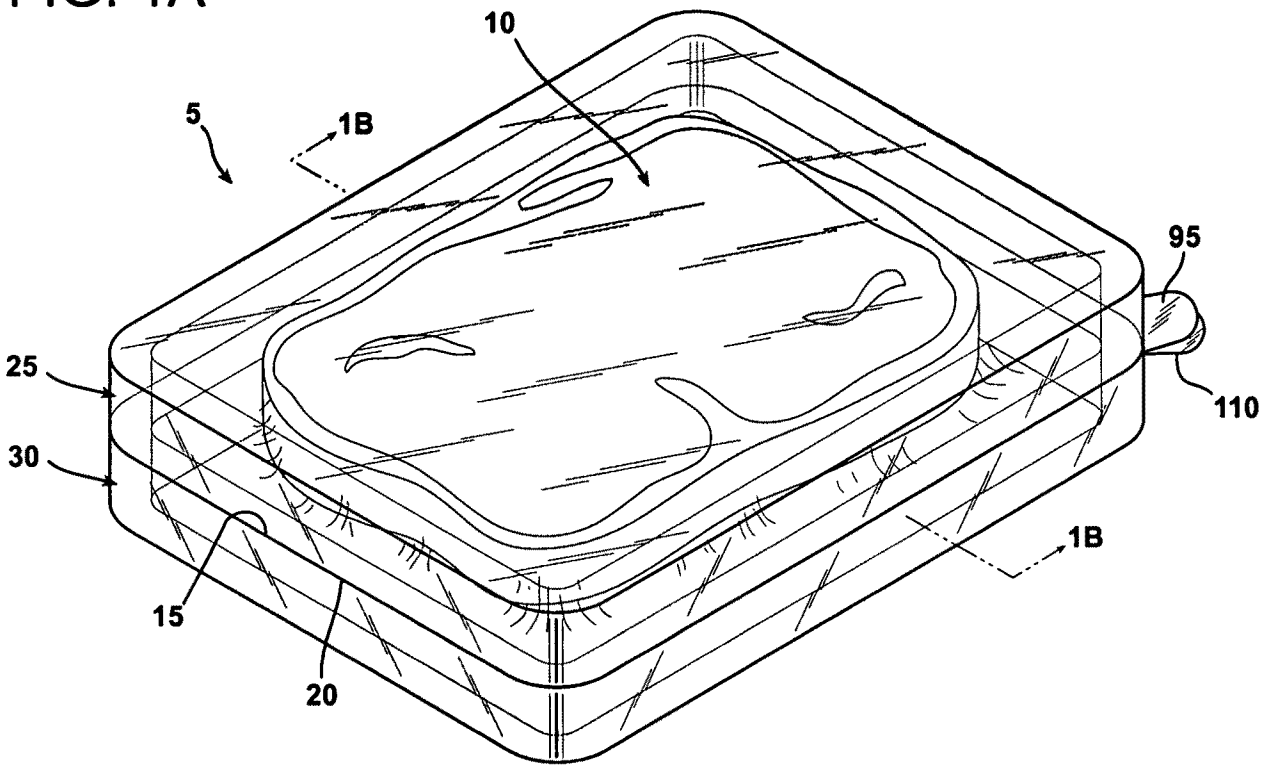
FIG. 1*a* is a perspective view of one embodiment of an article of the presently disclosed subject matter.
Figure 1B:
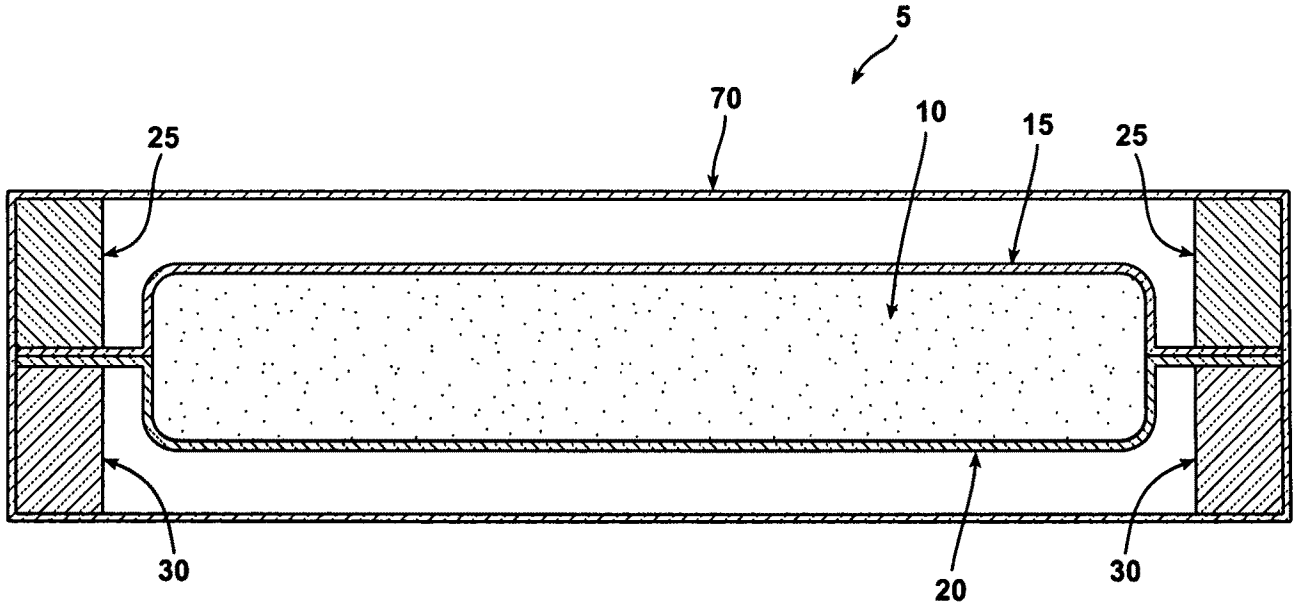
FIG. 1*b* is a vertical sectional view taken of the article of FIG. 1*a*.

FIGS. 1*a* and 1*b* illustrate an article, generally indicated at 5, incorporating the features of some embodiments of the presently disclosed subject matter. Particularly, article 5 comprises product 10 disposed within the interior of the article. As set forth in more detail herein below, product 10 can be vacuum skin packaged between upper and/or lower films 15, 20. The edges of the films can be clamped between upper and lower suspension frames 25, 30 to suspend the product. Thus, product 10 is suspended within the interior of the frames, much like a tray without a bottom. Additionally, product 10 is maintained out of contact with frames 25, 30. Accordingly, article 5 enables a consumer to view product 10 on all sides.

In addition, article 5 enables on-demand blooming of product 10. For example, in some embodiments, article 5 can comprise an outer oxygen-impermeable material (i.e., overwrap 70) that completely covers the article (i.e., upper and lower films 15, 20 and upper and lower frames 25, 30 are covered by the overwrap). In some embodiments, upper and lower films 15, 20 are oxygen-permeable, while overwrap 70 and upper and lower frames 25, 30 are oxygen-impermeable. Thus, when the overwrap surrounds the article, it provides a barrier to the movement of oxygen from the outside environment into the article. At the time of desired blooming of product 10, overwrap 70 can be removed from article 5 to allow oxygen to pass through upper and lower films 15, 20 and ultimately contact and bloom the product.

The description of the presently disclosed subject matter is discussed herein primarily in relation to meat products whose associated packaging problems are typical of those that the presently disclosed subject matter considers. However, it should be appreciated that the presently disclosed subject matter can also be applied to other oxygen-sensitive foodstuffs and articles to be packaged.

II. Definitions

While the following terms are believed to be understood by one of ordinary skill in the art, the following definitions are set forth to facilitate explanation of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" can refer to "one or more" when used in the subject specification, including the claims. Thus, for example, reference to "an article" includes a plurality of such articles, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, or percentage can encompass variations of, in some embodiments ±20%, in some embodiments ±10%, in some embodiments ±5%, in some embodiments ±1%, in some embodiments ±0.5%, and in some embodiments to ±0.1%, from the specified amount, as such variations are appropriate in the disclosed system and methods.

As used herein, the phrase "abuse layer" refers to an outer film layer and/or an inner film layer, so long as the film layer serves to resist abrasion, puncture, and other potential causes of reduction of package integrity, as well as potential causes of reduction of package appearance quality. An abuse layer can comprise any polymer, so long as the polymer contributes to achieving an integrity goal and/or an appearance goal. In some embodiments, an abuse layer can comprise polymers having a modulus of at least $10^7$ Pascals, at room temperature. In some embodiments, an abuse layer can comprise (but is not limited to) polyamide and/or ethylene/propylene copolymer, polypropylene; in some embodiments, nylon 6, nylon 6/6, and/or amorphous nylon.

The term "article" as used herein refers to packaging materials used in the packaging of a product. In some embodiments, the disclosed article can comprise a product packaged between upper and lower films, at least one suspension frame, and an impermeable material covering at least one of the upper and lower films.

The term "bag" as used herein refers to bags, pouches, sacks, packs, and the like. In some embodiments, the term "bag" can include L-seal bags, side-seal bags, end-seal bags, and backseamed bags. An L-seal bag has an open top, a bottom seal, one side-seal along a first side edge, and a seamless (i.e., folded, unsealed) second side edge. A side-seal bag has an open top, a seamless bottom edge, with each of its two side edges having a seal therealong. An end-seal bag has an open top, seamless side edges, and a seal across the bottom of the bag. A backseamed bag has an open top, a seal across the bottom, seamless side edges, and a seal running the length of the bag, this seal being in one of the lay-flat sides of the bag. In an L-seal bag, a side-seal bag, an end-seal bag, and a backseamed bag, the film is sealed to itself to form the bag. In contrast, a pouch has an open top, a seal across the bottom, and seals running up each side edge, resulting in a U-seal pattern. A pouch is made by sealing two separate pieces of film to one another. Several of these various bag types are disclosed in U.S. Pat. No. 6,790,468, to Mize et al., the entire content of which is hereby incorporated by reference.

The term "bulk layer" as used herein refers to a layer used to increase the abuse-resistance, toughness, modulus, etc., of a film. In some embodiments, the bulk layer can comprise polyolefin, including but not limited to at least one member selected from the group comprising: ethylene/alpha-olefin copolymer, ethylene/alpha-olefin copolymer plastomer, low density polyethylene, and/or linear low density polyethylene and polyethylene vinyl acetate copolymers.

The term "case ready" refers to an article that is pre-packaged and/or labeled at a centralized location and delivered to a retail market in a format whereby it is ready for immediate display and sale. A case ready article actively extends the quality life of a product (for example, a fresh meat product) to allow for the extra time that it takes to be packaged at a centrally located facility, distributed to the retail market, and then displayed for consumer selection and purchase.

As used herein, the phrase "easy open" refers to any means for accessing the contents of an article that obviates the need to cut and/or pierce the article with a knife, scissors, or any other sharp implement. An easy open feature can be in at least one portion of the web used to form an article and can include one or more cuts, notches, or surface-roughened areas, lines of structural weakness, or combinations thereof. Examples of such easy open features are described in U.S. Patent Application Publication Nos. 2005/0084636 to Papenfuss et al. and 2005/0254731 to Berbert et al., both of which are incorporated herein in their entireties. In some embodiments, the easy open feature can include one or more frangible or peelable layers adapted to manually separate or delaminate at least a portion of the web used to form the article, as described in U.S. Reissued Pat. No. RE37,171 to Busche et al., which is incorporated herein in its entirety. It will be appreciated that in some embodiments peelable webs can further comprise one or more reclosable peelable layers. Examples of still other alternative easy open features include reclosable interlocking fasteners attached to at least a portion of the web used to form the article. Reclosable fasteners, in general, are known and are taught, for example, in U.S. Pat. Nos. 5,063, 644; 5,301,394; 5,442,837; 5,964,532; 6,409,384; 6,439,770; 6,524,002; 6,527,444; 6,609,827; 6,616,333; 6,632,021; 6,663,283; 6,666,580; 6,679,027; and U.S. Patent Application Nos. 2002/0097923; and 2002/0196987, all hereby incorporated by reference in their entireties.

As used herein, the term "exterior layer" refers to a layer comprising the outermost surface of a web or product.

As used herein, the term "film" includes, but is not limited to, a laminate, sheet, web, coating, and/or the like, that can be used to package a product. The film can be a rigid, semi-rigid, or flexible.

The terms "food contact layer" and/or "food contact surface" refer to the portion of a packaging material that contacts a packaged product, such as for example, meat.

The term "hole" as used herein refers to both a true hole of any suitable shape and size, as well as cross-slits, perforations, partially cut-out flaps, or the like.

The term "interior layer" as used herein refers to a layer comprising the innermost surface of a web or product. For example, an interior layer can form the interior surface of an enclosed article. In some embodiments, the interior layer can be the food-contact layer and/or the sealant layer.

The term "meat" or "meat product" refers to any myoglobin-containing or hemoglobin-containing tissue from an animal, such as beef, pork, veal, lamb, mutton, chicken or turkey; and game such as venison, quail, and duck. The meat can be in a variety of forms including primal cuts, subprimal cuts, and/or retail cuts as well as ground, comminuted, or mixed. The meat or meat product is preferably fresh, raw, uncooked meat, but can also be frozen, hard chilled, or thawed. In some embodiments, the meat can be subjected to other irradiative, biological, chemical and/or physical treatments. The suitability of any particular such treatment can be determined without undue experimentation in view of the present disclosure.

As used herein, the term "on demand" refers to the ability to allow a user to initiate a particular feature at any desired time. Thus, for example, as used herein, "on demand blooming" refers to the ability of a user to initiate blooming of a product within an article at any desired time.

As used herein, the term "oxygen-impermeable," and the phrase "oxygen-impermeable layer," as applied to films and/or layers, is used with reference to the ability of a film or layer to serve as a barrier to one or more gases (i.e., gaseous $O_2$). Such barrier materials can include (but are not limited to) ethylene/vinyl alcohol copolymer, polyvinyl alcohol homopolymer, polyvinyl chloride, homopolymer and copolymer of polyvinylidene chloride, polyalkylene carbonate, polyamide, polyethylene naphthalate, polyester, polyacrylonitrile, homopolymer and copolymer, liquid crystal polymer, SiOx, carbon, metal, metal oxide, and the like, as known to those of ordinary skill in the art. In some embodiments, the oxygen-impermeable film has an oxygen transmission rate of no more than 100 cc $O_2/m^2$·day·atm; in some embodiments, less than 50 cc $O_2/m^2$·day·atm; in some embodiments, less than 25 cc $O_2/m^2$·day·atm; in some embodiments, less than 10 cc $O_2/m^2$·day·atm; in some embodiments, less than 5 cc $O_2/m^2$·day·atm; in some embodiments, less than 1 cc $O_2/m^2$·day·atm (tested at 1 mil thick and at 25° C. in accordance with ASTM D3985).

As used herein, the term "oxygen-permeable" as applied to films and/or layers refers to a film packaging material that can permit the transfer of oxygen from the exterior of the film (i.e., the side of the film not in contact with the packaged product) to the interior of the film (i.e., the side of the film in contact with the packaged product). Thus, oxygen can permeate through upper and/or lower films 15, 20 to contact product 10. In some embodiments, "oxygen-permeable" can refer to films or layers that have a gas (e.g., oxygen) transmission rate of at least about 1,000 cc/$m^2$/24 hrs/atm at 73° F.; in some embodiments, at least about 5,000 cc/$m^2$/24 hrs/atm at 73° F.; in some embodiments, at least about 10,000 cc/$m^2$/24 hrs/atm at 73° F.; in some embodiments, at least about 50,000 cc/$m^2$/24 hrs/atm at 73° F.; and in some embodiments, at least about 100,000 cc/$m^2$/24 hrs/atm at 73° F. The term "permeable" can also refer to films that do not have such high gas permeability, but that are sufficiently permeable to affect a sufficiently rapid bloom for the particular product and particular end-use application.

As used herein, the term "oxygen scavenger" or "oxygen scavenging material" refers to a composition, article, or the like that consumes, depletes, or reduces the amount of oxygen from a given environment. Oxygen scavengers that can be used in the presently disclosed subject matter are disclosed in U.S. Pat. Nos. 5,310,497; 5,350,622; and 5,399,289 (Speer et al.), and a method of initiating oxygen scavenging generally is disclosed in U.S. Pat. No. 5,211,875 (Speer et al.). All of these four patents are incorporated herein by reference in their entirety.

The term "oxygen-sensitive" as used herein refers to the ability of a product to react with oxygen. The term includes products that oxidize in the presence of oxygen, such as whole grains, fruit, and the like. The term also includes products such as fresh red meat that bloom in the presence of oxygen.

As used herein, the term "polymer" (and specific recited polymers) refer to the product of a polymerization reaction, and is inclusive of homopolymers, copolymers, terpolymers, etc.

As used herein, the term "polymerization" can be inclusive of homopolymerizations, copolymerizations, terpolymerizations, etc., and can include all types of copolymerizations such as random, graft, block, etc. In general, the polymers in the films of the presently disclosed subject matter can be prepared in accordance with any suitable polymerization process, including slurry polymerization, gas phase polymerization, high pressure polymerization processes, and the like.

As used herein, the term "preservation enhancing gas" refers to gases used in MAP applications as described herein. Particularly, such gas environments have a composition that is altered from that of ambient air for the purpose of extending the shelf life, enhancing the appearance, and/or reducing the degradation of a packaged product. Such gases can include (but are not limited to) carbon dioxide, carbon monoxide, nitrogen, argon, and the like, and mixtures of such gases, as would be apparent to those of ordinary skill in the packaging art.

As used herein, the term "seal" refers to any seal of a first region of a film surface to a second region of a film surface, wherein the seal is formed by heating the regions to at least their respective seal initiation temperatures. The heating can be performed by any one or more of a wide variety of manners, such as using a heated bar, hot air, infrared radiation, radio frequency radiation, etc.

As used herein, the phrases "seal layer", "sealing layer", "heat seal layer", and "sealant layer", refer to an outer film layer, or layers, involved in the sealing of the film to itself, another film layer of the same or another film, and/or another article that is not a film. It should also be recognized that in general, up to the outer 3 mils of a film can be involved in the sealing of the film to itself or another layer. With respect to packages having only fin-type seals, as opposed to lap-type seals, the phrase "sealant layer" generally refers to the inside film layer of an article, as well as supporting layers adjacent this sealant layer often being sealed to itself, and frequently serving as a food contact layer in the packaging of foods. In general, a sealant layer sealed by heat-sealing layer comprises any thermoplastic polymer. In some embodiments, the heat-sealing layer can comprise, for example, thermoplastic polyolefin, thermoplastic polyamide, thermoplastic polyester, and thermoplastic polyvinyl chloride. In some embodiments, the heat-sealing layer can comprise thermoplastic polyolefin.

The term "suspended" or "suspension" as used herein is not intended to require that anything, such as a packaged product, is suspended above anything. Rather, the term is only intended to reflect that the packaged product is held in a position spaced from another member, such as at least one of the walls of a frame.

As used herein, the term "tie layer" refers to an internal film layer having the primary purpose of adhering two layers to one another. In some embodiments, tie layers can comprise any nonpolar polymer having a polar group grafted thereon, such that the polymer is capable of covalent bonding to polar polymers such as polyamide and ethylene/vinyl alcohol copolymer. In some embodiments, tie layers can comprise at least one member selected from the group including, but not limited to, modified polyolefin, modified ethylene/vinyl acetate copolymer, and/or homogeneous ethylene/alpha-olefin copolymer. In some embodiments, tie layers can comprise at least one member selected from the group consisting of anhydride modified grafted linear low density polyethylene, anhydride grafted low density polyethylene, homogeneous ethylene/alpha-olefin copolymer, and/or anhydride grafted ethylene/vinyl acetate copolymer.

As used herein, the terms "upper" and "lower" are used merely to provide a frame of reference. Thus, an upper film can be positioned at a higher elevation compared to a lower film.

The term "vacuum skin packaging" or "VSP" as used herein refers to a process wherein a thermoformable film (i.e., capable of being formed into a desired shape upon the application of heat) is thermoformed about a product on a tray by means of heat and/or pressure. Virtually all of the air is evacuated from a predefined space around the article so that when the film is attached to the tray about the product and the resultant article is subsequently exposed to atmospheric pressure, the film conforms very closely to the contour of the packaged product. Further details are described in U.S. Pat. No. RE 30,009 to Purdue et al.; U.S. Pat. No. 5,346,735 to Logan et al.; U.S. Pat. No. 3,835,618 to Perdue; U.S. Pat. No. 6,042,913 to Miranda et al.; and U.S. Pat. No. 5,770,287 to Miranda et al., the entire disclosures of which are incorporated by reference herein.

Although the majority of the above definitions are substantially as understood by those of skill in the art, one or more of the above definitions can be defined hereinabove in a manner differing from the meaning as ordinarily understood by those of skill in the art, due to the particular description herein of the presently disclosed subject matter.

III. The Disclosed Suspension Article

III.A. Oxygen-Sensitive Product 10

Oxygen-sensitive product 10 can comprise both food and non-food items. Examples of food items that are suitable for use with the presently disclosed subject matter include (but are not limited to) meat, vegetables, fruit, pasta, and the like. While a wide variety of food products can be packaged in accordance with the teachings of the presently disclosed subject matter, it is particularly advantageous in connection with the packaging of fresh red meat such that the meat can be transported and then allowed to bloom at a desired time by exposure to oxygen in the ambient environment. One of ordinary skill in the art would readily recognize that the above list is not exhaustive and can include any of a wide variety of food products.

Non-food items suitable for use with the presently disclosed subject matter can include (but are not limited to) pharmaceuticals, photographic film, computer components, inorganic materials susceptible to oxidation, electronics, biological systems, medical devices, digital media (such as DVDs with surfaces that are destroyed by oxygen), and the like. One of ordinary skill in the art would readily recognize that the above list is not exhaustive and can include any of a wide variety of non-food items.

Figure 10A:
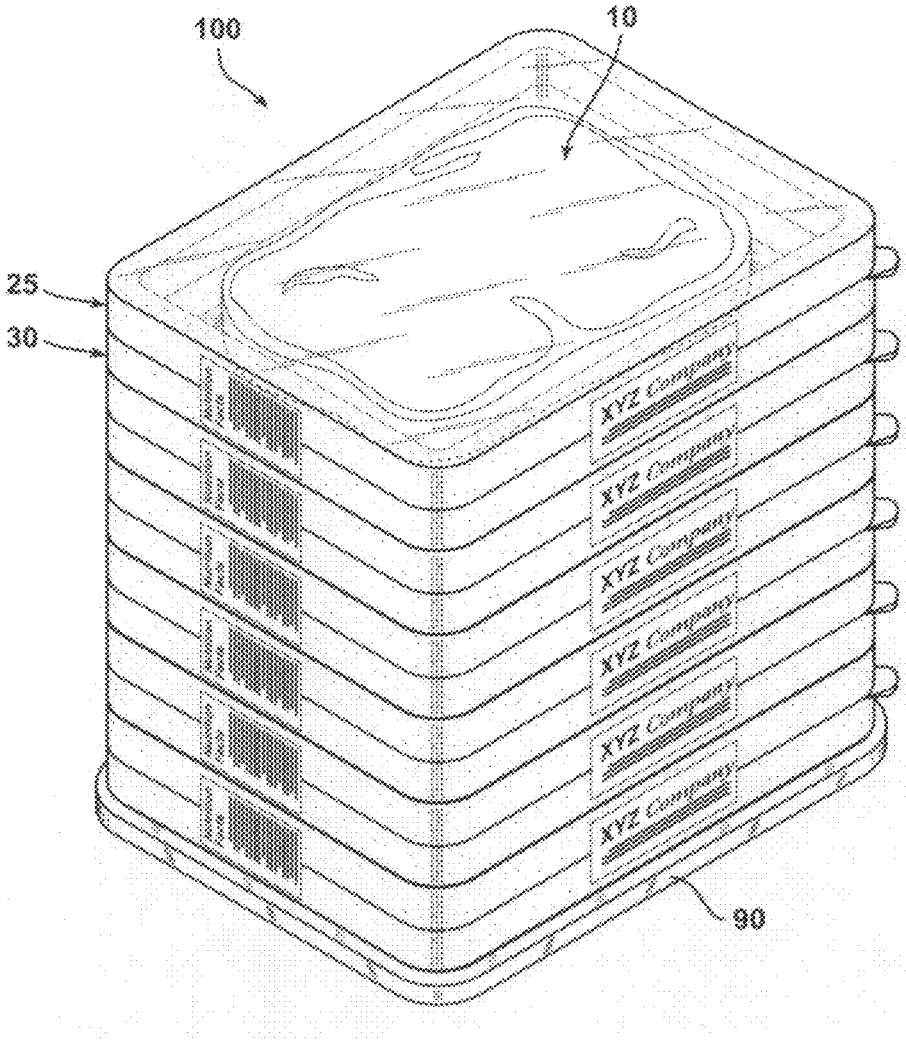
FIG. 10*a* is a perspective view of one embodiment of the disclosed article.
Figure 10C:
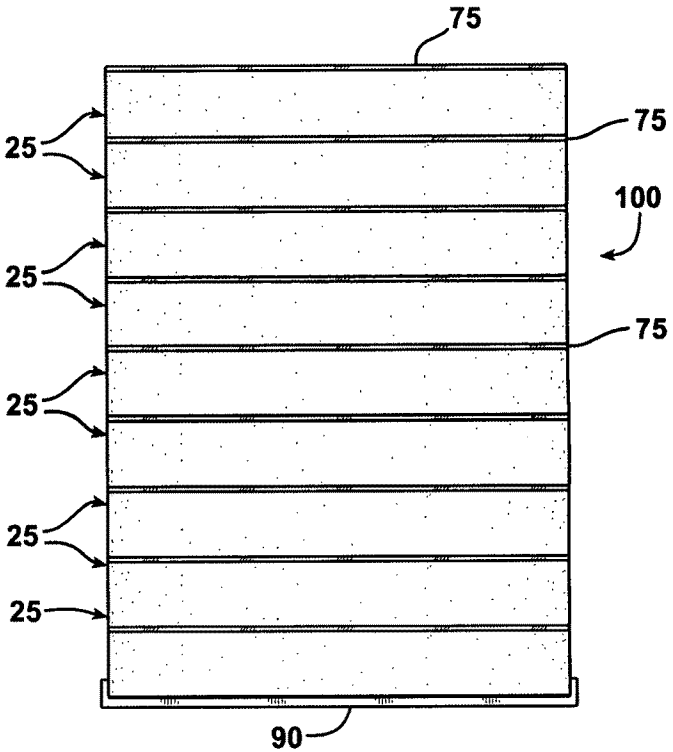
FIGS. 10*b*-10*e* are front elevation views of several embodiments of the disclosed article.

For example, in some embodiments, DVDs (or other digital media) can be coated with a material that makes the DVD unreadable after prolonged exposure to oxygen, such that they are intended to have a very limited use. In such embodiments, the DVDs can be packaged and stacked as illustrated in FIG. 10*c*, with an oxygen-impermeable film on bottom and an oxygen-permeable film on top of each DVD package. The stack can be vacuumized and sealed together, such that when purchased, the bottom package is removed from the stack. The DVD is then exposed to oxygen through the oxygen-permeable top film, and the remaining DVDs in the stack are protected from atmospheric oxygen through the bottom oxygen-impermeable film in the bottom DVD.

III.B. Upper and Lower Films 15, 20

Figure 2A:
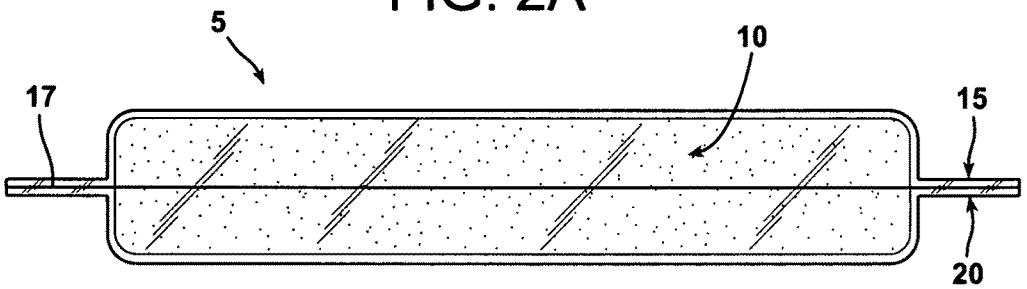
FIGS. 2*a* and 2*b* are front elevation views of two embodiments of a product packaged between 2 films in accordance with the presently disclosed subject matter.
Figure 2B:
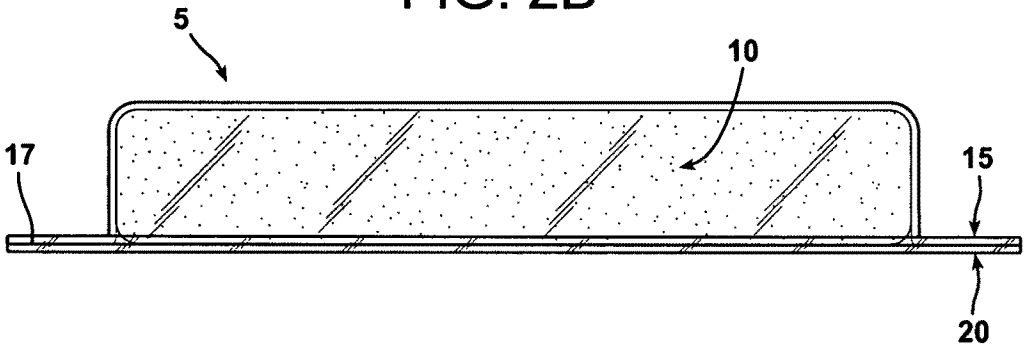

Product 10 is packaged between upper and lower films 15, 20. In some embodiments, the product is vacuum skin packaged between both upper and lower films 15, 20, as depicted in FIG. 2*a*. Alternatively, in some embodiments, product 10 can be positioned on lower film 20, which functions as a support film. Upper film 15 is then vacuum skin packaged thereon, as depicted in FIG. 2*b*. Vacuum packaging, and particularly vacuum skin packaging ("VSP"), has become an increasingly attractive way of packaging fresh red meats. Specifically, a product is packaged between heated upper and/or lower films that are sealed together at interface 17. See, for example, U.S. Pat. No. 5,491,009 to Bekele and U.S. Pat. No. 3,694,991 to Purdue, the entire disclosures of which are hereby incorporated by reference.

At least one of upper and lower films 15, 20 is oxygen-permeable to promote on-demand blooming. Particularly, article 5 can comprise an outer oxygen-impermeable material (i.e., an oxygen-impermeable outer film, an oxygen-impermeable overwrap, and/or an oxygen-impermeable outer bag, as discussed herein below). At a desired point (e.g., after the article arrives at a supermarket or other retail outlet), the oxygen-impermeable material can be removed such that the oxygen-permeable film is exposed to oxygen in the ambient atmosphere. Oxygen then permeates into the interior space of the article and blooms product 10. Thus, in embodiments wherein both upper and lower films 15, 20 are oxygen-permeable, once the outer oxygen-impermeable material is removed, oxygen can permeate both films to contact and bloom product 10. In embodiments wherein only one of films 15, 20 is oxygen-permeable, once the outer oxygen-impermeable material is removed, oxygen can permeate through the oxygen-permeable film to bloom product 10.

Accordingly, at least one of films 15, 20 is oxygen-permeable. Thus, films 15 and/or 20 can comprise oxygen-permeable materials, such as (but not limited to) one or more of the following: Tyvek®, polyvinylchloride, polycarbonate, cellophane, polypropylene, polyethylene, polyethylene copolymer, ionomer film, ethylene copolymers including, for example, ethylene vinyl acetate ("EVA"), ethylene acrylate copolymers, ethylene acrylic acid copolymers including metal neutralized salts thereof, and ethylene alpha-olefin copolymers. Such ethylene alpha-olefins can be heterogeneous or homogeneous in nature. That is, ethylene alpha-olefins that have been formed by conventional Zeigler-Natta catalysis and are heterogeneous in nature, such as linear low density polyethylene ("LLDPE"), are within the scope of the presently disclosed subject matter as well as such copolymers that are formed by single site catalysis, such as any of a variety of forms of metallocene catalyst technology, and are homogeneous in nature are also within the scope of the presently disclosed subject matter. In addition, in some embodiments, the oxygen permeable material can comprise coated paper, which is permeable to gases such as ethylene oxide. Such materials are well known to those of ordinary skill in the art.

A representative permeable film for use in accordance with the presently disclosed subject matter is a symmetrical, five layer oriented film having the structure: EVA/LLDPE/EVA/LLDPE/EVA, although a wide variety of permeable films can be employed. Alternatively or in addition, in some embodiments, films 15, 20 can be constructed of microporous films of any nature in which holes have been induced chemically or mechanically, such films being particularly useful where a high degree of breathability is required.

In embodiments wherein only one of films 15, 20 is oxygen-permeable, the other film (15 or 20) can be oxygen-impermeable. Thus, in some embodiments, film 15 or 20 can comprise oxygen-impermeable materials, such as (but not limited to) one or more of the following: ethylene/vinyl alcohol copolymer (EVOH), polyvinylidene dichloride (PVDC), polyvinyl alcohol (PVOH), vinylidene chloride copolymer such as vinylidene chloride/methyl acrylate copolymer, vinylidene chloride/vinyl chloride copolymer, polyamide, polyester, polyacrylonitrile (available as Barex™ resin), or blends thereof. Alternatively or in addition, the oxygen-impermeable film can comprise a film coated with an oxygen barrier material, such as SiOx or AlOx. Such materials are well known to those of ordinary skill in the art.

A representative oxygen-impermeable film for use in accordance with the presently disclosed subject matter is a five layer film having the structure: Nylon/PVDC//EVA/LLDPE/seal, wherein the double slashes (//) indicate adhesive lamination of the two webs, although a variety of laminates and multilayer films can be employed as the impermeable web of the presently disclosed subject matter.

In addition to the oxygen-permeable or oxygen-impermeable materials or layers, films 15, 20 can also comprise one or more seal layers, tie layers, abuse layers, and/or bulk layers as would be known to those of ordinary skill in the packaging art.

The polymer components used to fabricate films 15, 20 according to the presently disclosed subject matter can also comprise appropriate amounts of other additives normally included in such compositions. For example, slip agents (such as talc), antioxidants, fillers, dyes, pigments and dyes, radiation stabilizers, antistatic agents, elastomers, and the like can be added to the disclosed films. See, for example, U.S. Pat. No. 7,205,040 to Peiffer et al.; U.S. Pat. No. 7,160,378 to Eadie et al.; U.S. Pat. No. 7,160,604 to Ginossatis; U.S. Pat. No. 6,472,081 to Tsai et al.; U.S. Pat. No. 6,222,261 to Horn et al.; U.S. Pat. No. 6,221,470 to Ciacca et al.; U.S. Pat. No. 5,591,520 to Migliorini et al.; and U.S. Pat. No. 5,061,534 to Blemberg et al., the disclosures of which are hereby incorporated by reference in their entireties.

Upper and lower films 15, 20 can be multilayer or monolayer. Typically, however, the films employed will have two or more layers in order to incorporate a variety of properties, such as, for example, sealability, gas permeability, and toughness into a single film. Thus, in some embodiments, films 15, 20 comprise a total of from about 4 to about 20 layers; in some embodiments, from about 4 to about 12 layers; and in some embodiments, from about 5 to about 9 layers. Accordingly, films 15, 20 can comprise 1, 2, 3, 4, 5, 6, 7, 8, 9, 10, 11, 12, 13, 14, 15, 16, 17, 18, 19, or 20 layers. One of ordinary skill in the art would also recognize that films 15, 20 can comprise more than 20 layers, such as in embodiments wherein the films comprise microlayering technology.

Films 15, 20 can have any total thickness desired, so long as the film provides the desired properties for the particular packaging operation in which the film is used, e.g., optics, modulus, seal strength, and the like. Final web thicknesses can vary, depending on the process, end use application, and the like. Typical thicknesses can range from about 0.1 to 20 mils; in some embodiments, about 0.3 to 15 mils; in some embodiments, about 0.5 to 10 mils; in some embodiments, about 1 to 8 mils; in some embodiments, about 1 to 4 mils; and in some embodiments, about 1 to 2 mils.

In some embodiments, films 15, 20 can be transparent (at least in the non-printed regions) such that product 10 is visible on both sides of article 5 through the films. The term "transparent" as used herein can refer to the ability of a material to transmit incident light with negligible scattering and little absorption, enabling objects (e.g., packaged food) to be seen clearly through the material under typical unaided viewing conditions (i.e., the expected use conditions of the material). The transparency of the films can be at least about any of the following values: 20%, 25%, 30%, 40%, 50%, 65%, 70%, 75%, 80%, 85%, and 95%, as measured in accordance with ASTM D1746.

Figure 9A:
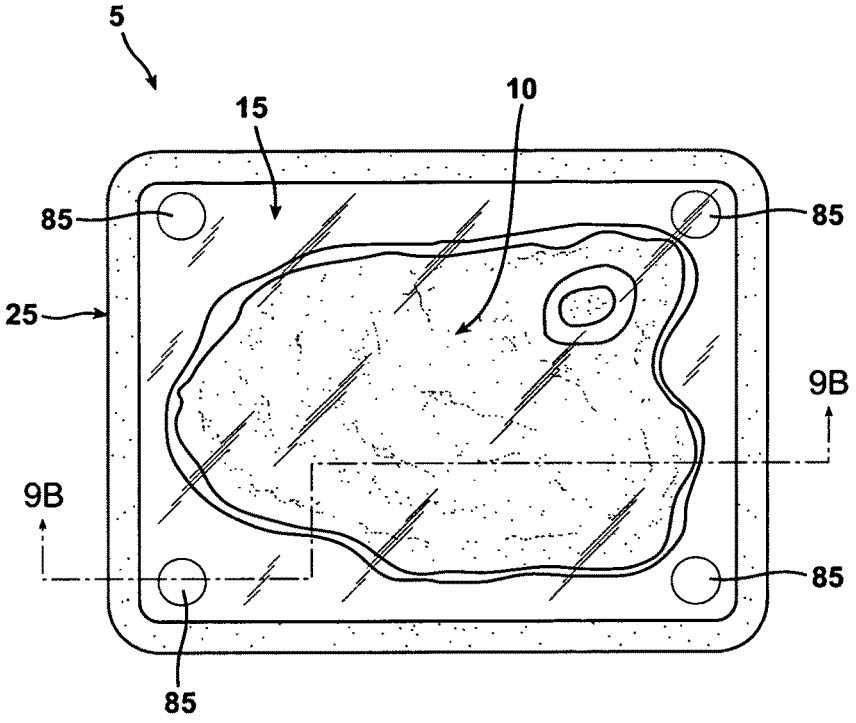
FIG. 9*a* is a top plan view of one embodiment of the disclosed article.

As depicted in FIG. 9*a* and discussed in more detail herein below, in some embodiments, films 15 and/or 20 can comprise one or more holes 85 to allow communication between both sides of the article. The holes are suitable for embodiments wherein suspension frames 25, 30 are sealed on both sides with outer oxygen-impermeable film 75, allowing one side to be peeled off to initiate blooming, as discussed herein below. Holes 85 allow oxygen exposure of the unpeeled side, and maintain a surface for labeling of the package. Also, in some embodiments, stack 100 can comprise holes 85. Particularly, each frame of the stack can comprise oxygen-impermeable film 75 on only one side such that when a frame is removed from the stack (without removing the oxygen-impermeable film), holes 85 allow for blooming of the product through permeable films 15, 20.

Holes 85 can have any desired diameter and any shape known to those of ordinary skill in the art. In addition, the holes can be spaced at uniform intervals in the film, or can be introduced at random. Holes 85 can be constructed in the film(s) using any method known to those of ordinary skill in the art, including (but not limited to) lasers, scissors, knives, and the like.

Upper and lower films 15, 20 can be constructed by any suitable process known to those of ordinary skill in the art, including (but not limited to) coextrusion, lamination, extrusion coating, and combinations thereof. See, for example, U.S. Pat. No. 6,769,227 to Mumpower, the content of which is herein incorporated by reference in its entirety.

In some embodiments, at least a portion of upper and lower films 15, 20 can be irradiated to induce crosslinking. In the irradiation process, the film is subjected to one or more energetic radiation treatments, such as corona discharge, plasma, flame, ultraviolet, X-ray, gamma ray, beta ray, and high energy electron treatment, each of which induces cross-linking between molecules of the irradiated material. The irradiation of polymeric films is disclosed in U.S. Pat. No. 4,064,296, to Bornstein et al., which is hereby incorporated by reference in its entirety.

III.C. Suspension Frames 25, 30

Figure 3A:
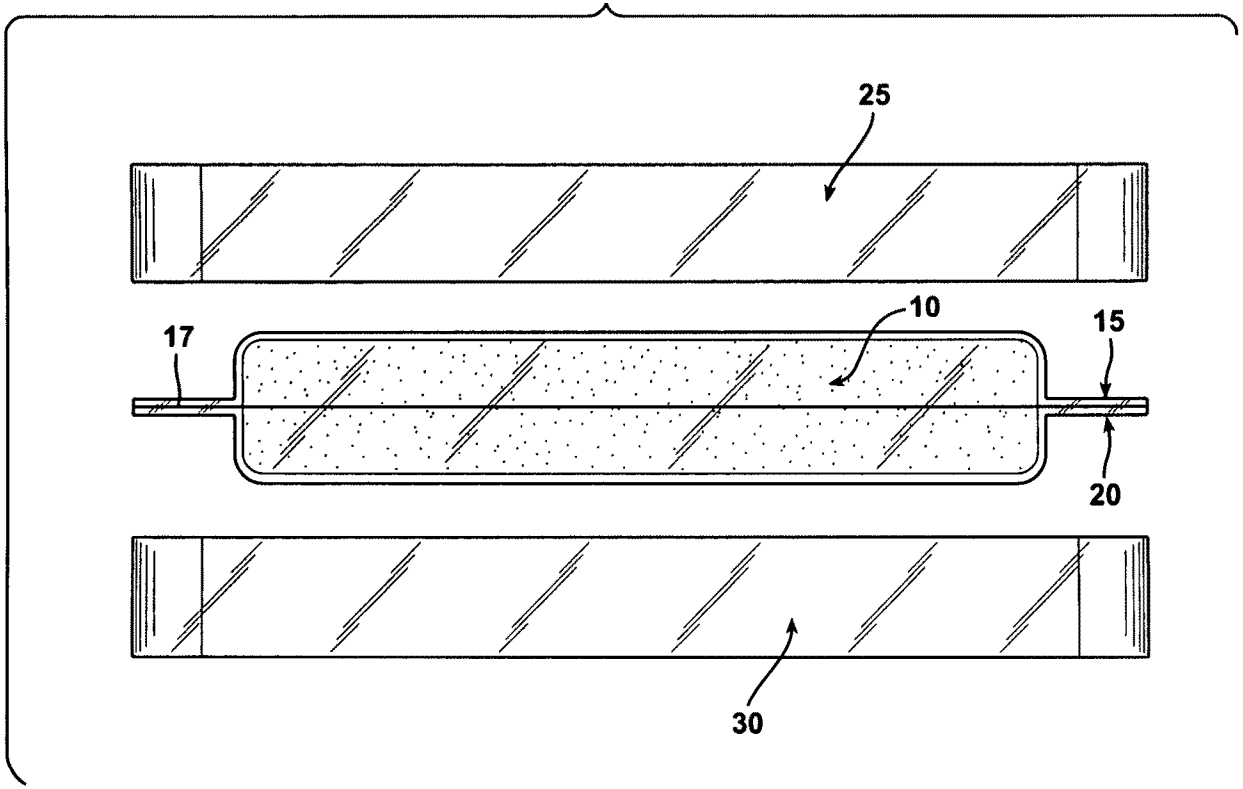
FIG. 3*a* is a front elevation view of one embodiment of a packaged product and two support frames.
Figure 3B:
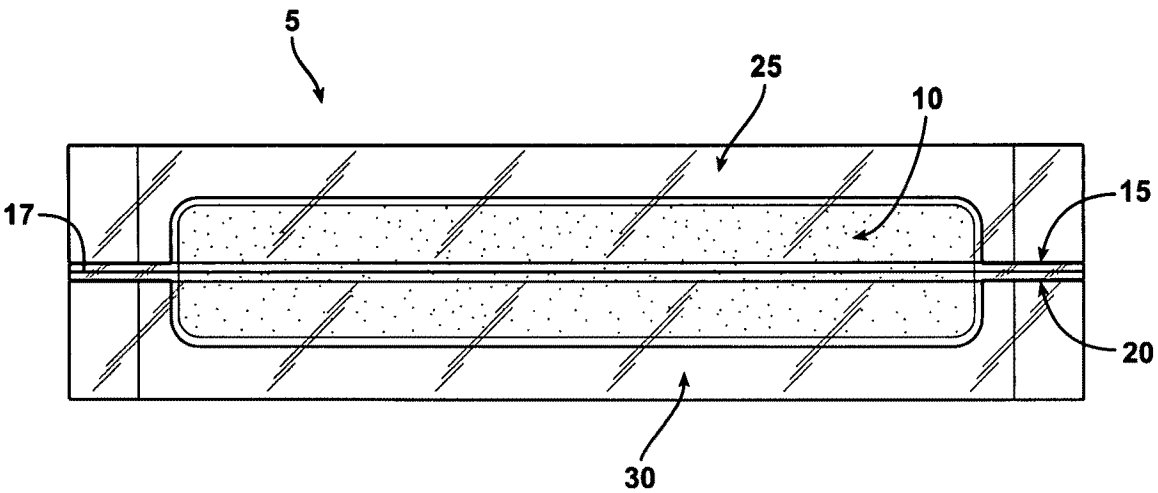
FIG. 3*b* is a front elevation view of the product of FIG. 3*a* after suspension frame assembly.
Figure 3C:
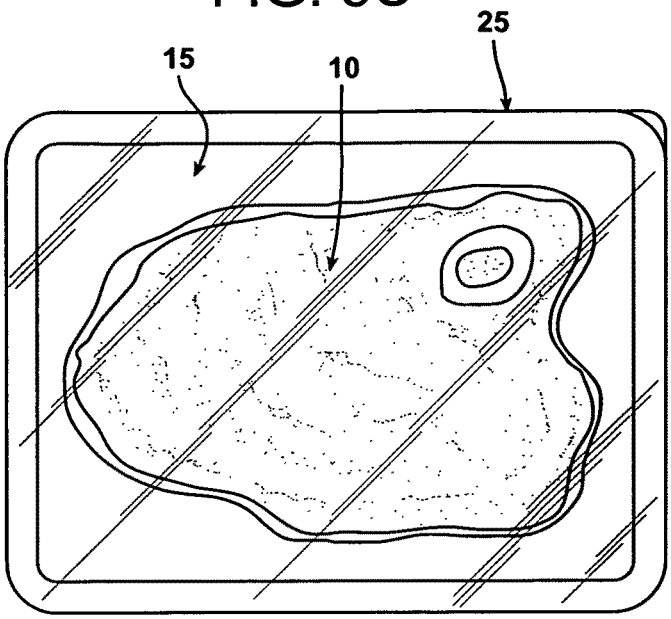
FIG. 3*c* is a top plan view of the article of FIG. 3*b*.
Figure 3D:
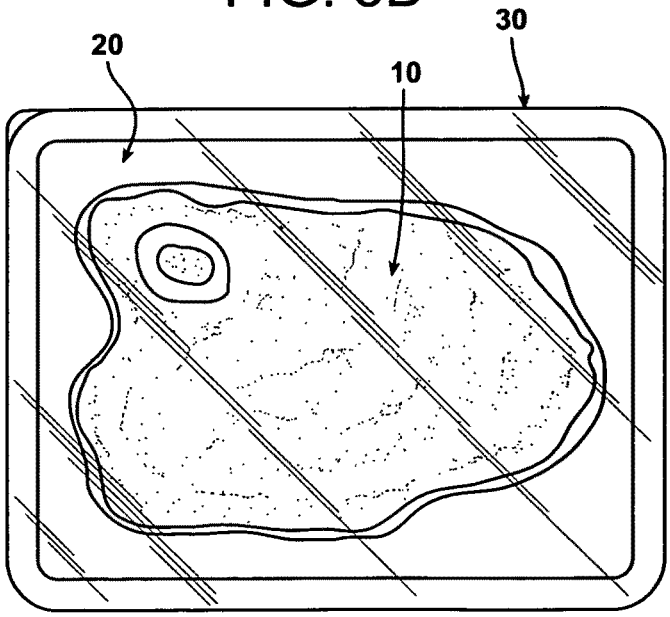
FIG. 3*d* is a bottom plan view of the article of FIG. 3*b*.

In some embodiments, the edges of upper and lower films 15, 20 are maintained between upper and lower suspension frames 25, 30 to suspend product 10. The film edges can be maintained between the frames by clamping the film edges between the frames, adhesive, mechanical closures, and the like, as would be apparent to those of ordinary skill in the art. Frames 25, 30 provide support for article 5 and protect product 10 from damage during shipping, handling, and the like. In embodiments wherein the product is vacuum skin packaged between both upper and lower films 15, 20 (as depicted in FIG. 2*a*), upper and lower frames 25, 30 can be initially positioned respectively above and below the films as illustrated in FIG. 3*a*. As illustrated in FIG. 3*b*, upper and lower films 15, 20 are then tightly clamped in between upper and lower frames 25, 30 to suspend the packaged product. FIGS. 3*c* and 3*d* illustrate top and bottom plan views, respectively, of the article of FIG. 3*b*. Thus, product 10 is suspended within article 5 using films 15, 20 and is maintained out of contact with frames 25, 30. In some embodiments, any film excess that extends past frames 25, 30 can be trimmed off using methods well known in the packaging art.

Figure 4A:
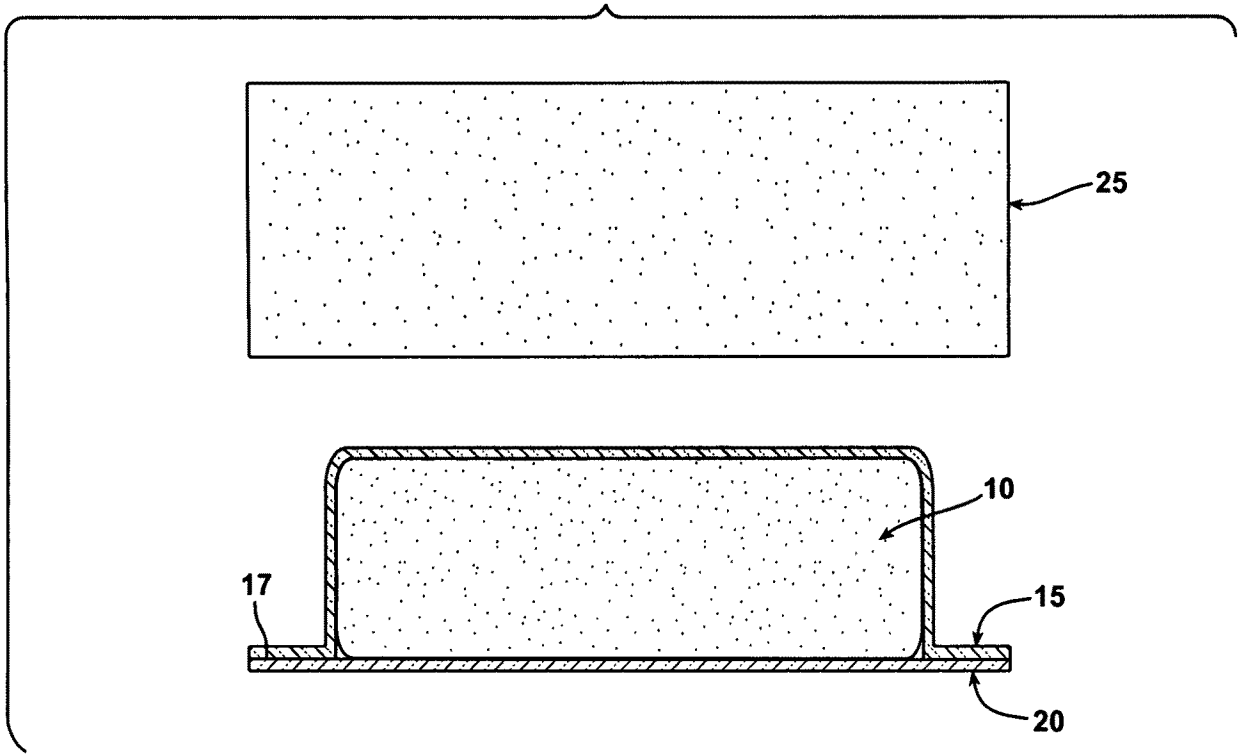
FIG. 4*a* is a front elevation view of one embodiment of a packaged product and one support frame.
Figure 4B:
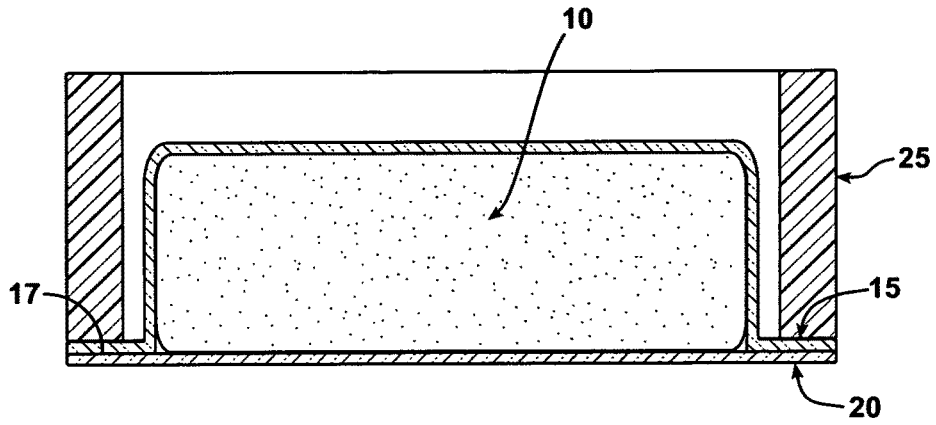
FIG. 4*b* is a front elevation view of the product of FIG. 4*a* after suspension frame assembly.
Figure 4C:
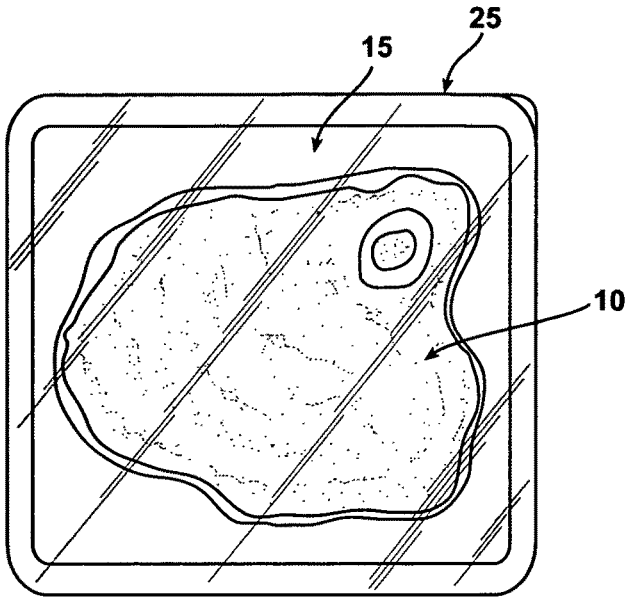
FIG. 4*c* is a top plan view of the article of FIG. 4*b*.
Figure 4D:
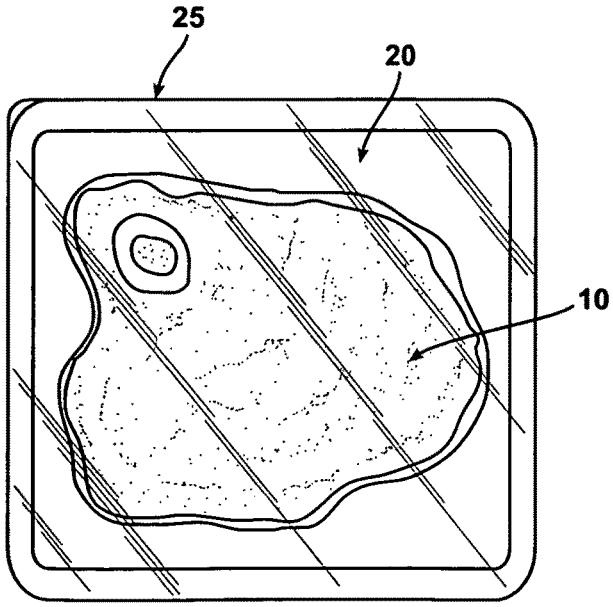
FIG. 4*d* is a bottom plan view of the article of FIG. 4*b*.

Alternatively, in some embodiments, the edges of films 15, 20 can be attached to a single frame. Particularly, the single frame can comprise either upper frame 25 or lower frame 30 (i.e., both frames are not required). For example, FIG. 4*a* illustrates an embodiment wherein packaged product 10 is positioned on lower film 20 and upper film 15 is vacuum skin packaged thereon. Film 15 can then be attached to the single frame (25 or 30) as depicted in FIG. 4*b* using any of a number of means commonly used in the art, including (but not limited to) adhesives, staples, heat seal, mechanical closures, and the like. FIGS. 4*c* and 4*d* illustrate top and bottom plan views, respectively, of the article of FIG. 4*b*.

Figure 5A:
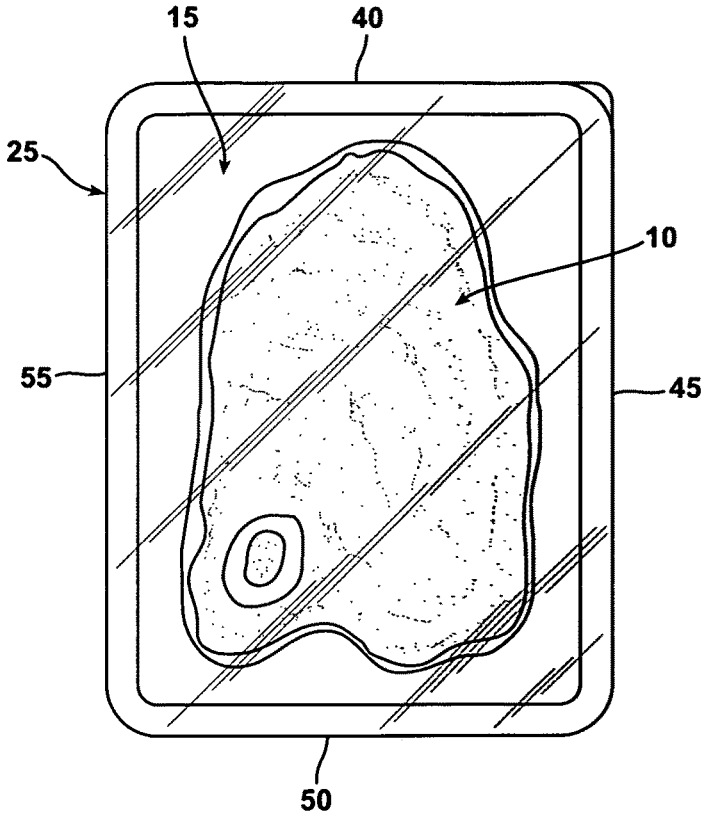
FIG. 5*a* is a top plan view of one embodiment of the disclosed article.
Figure 5B:
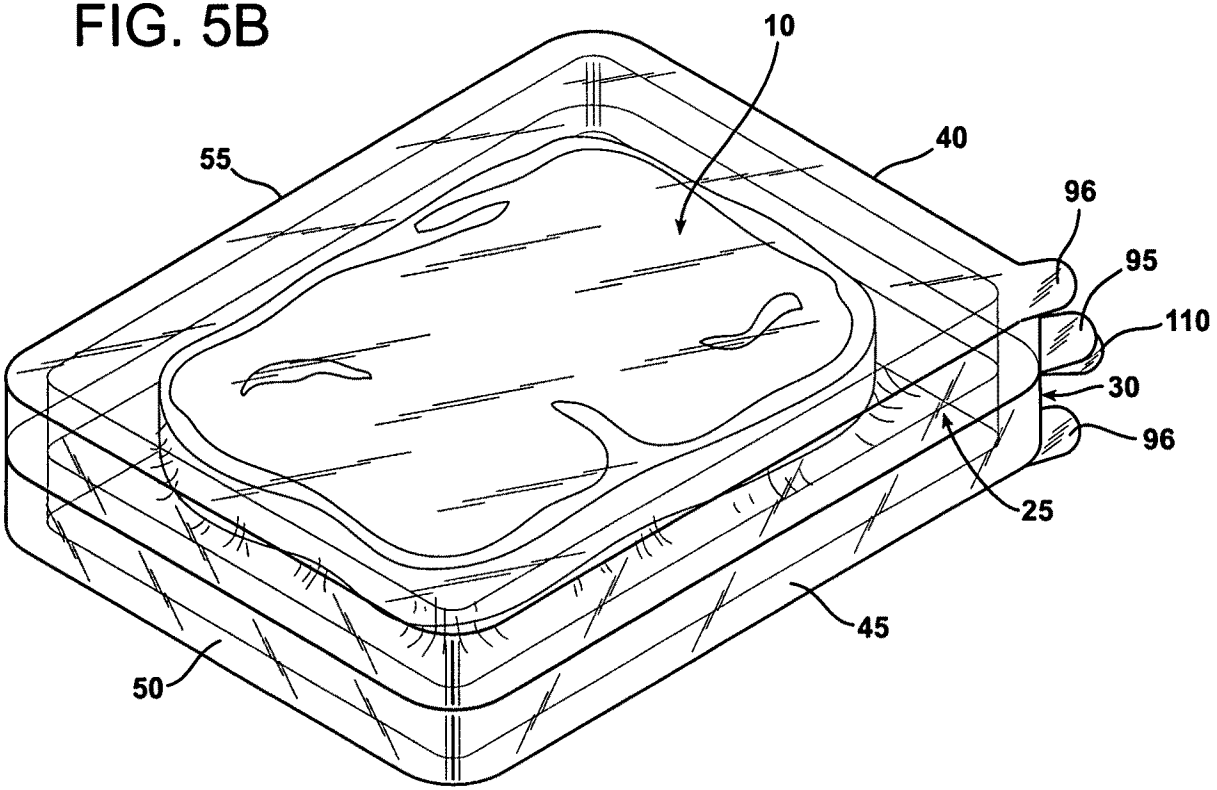
FIG. 5*b* is a perspective view of the article of FIG. 5*a*.
Figure 5C:
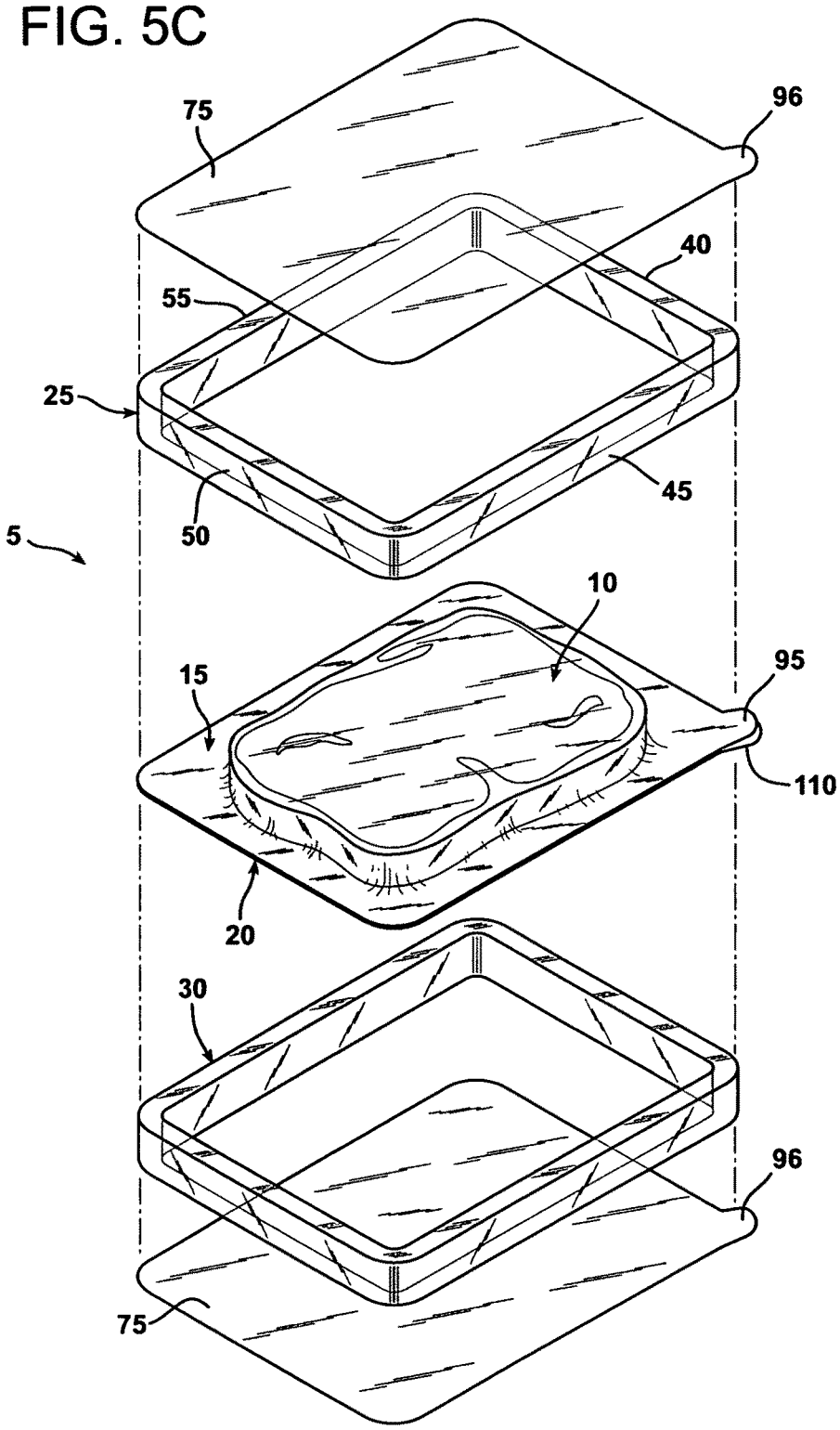
FIG. 5*c* is an exploded view of the article of FIG. 5*a*.

As depicted in FIGS. 5*a*-5*c*, in some embodiments, each frame comprises at least four upright side panels 40, 45, 50, and 55 and is open at its center. In some embodiments, each frame comprises two sets of parallel side panels, such as side panels 40 and 50 or 45 and 55. Upper and lower films 15, 20 are attached tightly between the side edges of at least one frame to suspend product 10 therein. Thus, in a rectangular frame such as illustrated in FIGS. 5*b* and 5*c*, films 15, 20 will generally be tightly clamped (or attached to) all four sides of frames 25, 30, but it will be understood that this may not be necessary in all circumstances. For example, in embodiments, wherein frames 25, 30 are hexagonal or octagonal in shape, films 15, 20 may not need to be attached to all six or all eight sides.

Figure 6A:
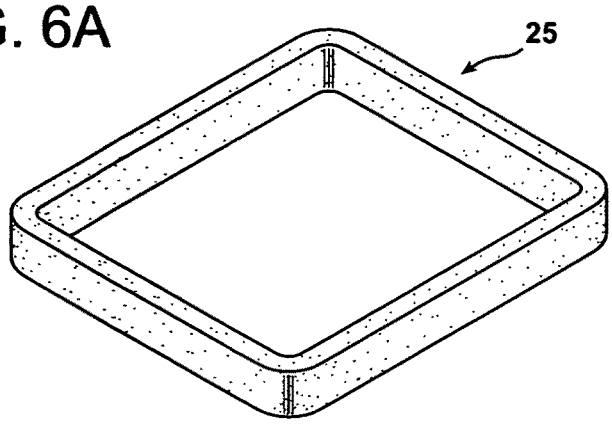
FIGS. 6*a*-6*d* are perspective views of alternate frame configurations suitable for use with the presently disclosed subject matter.
Figure 6B:
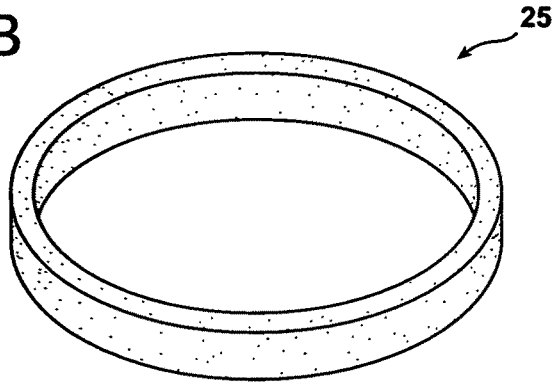
Figure 6C:
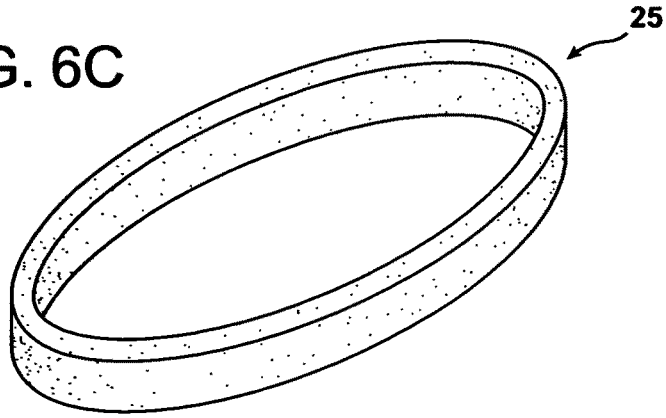
Figure 6D:
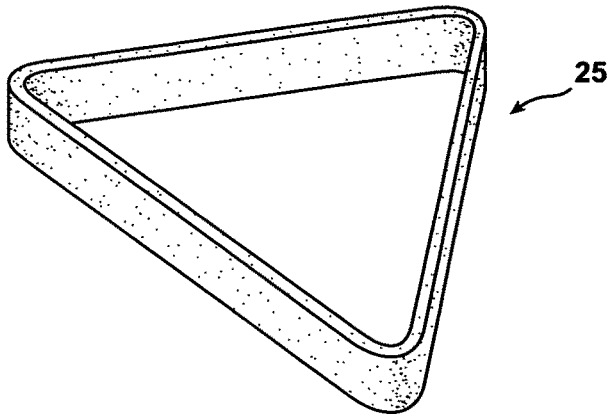
Figure 6E:
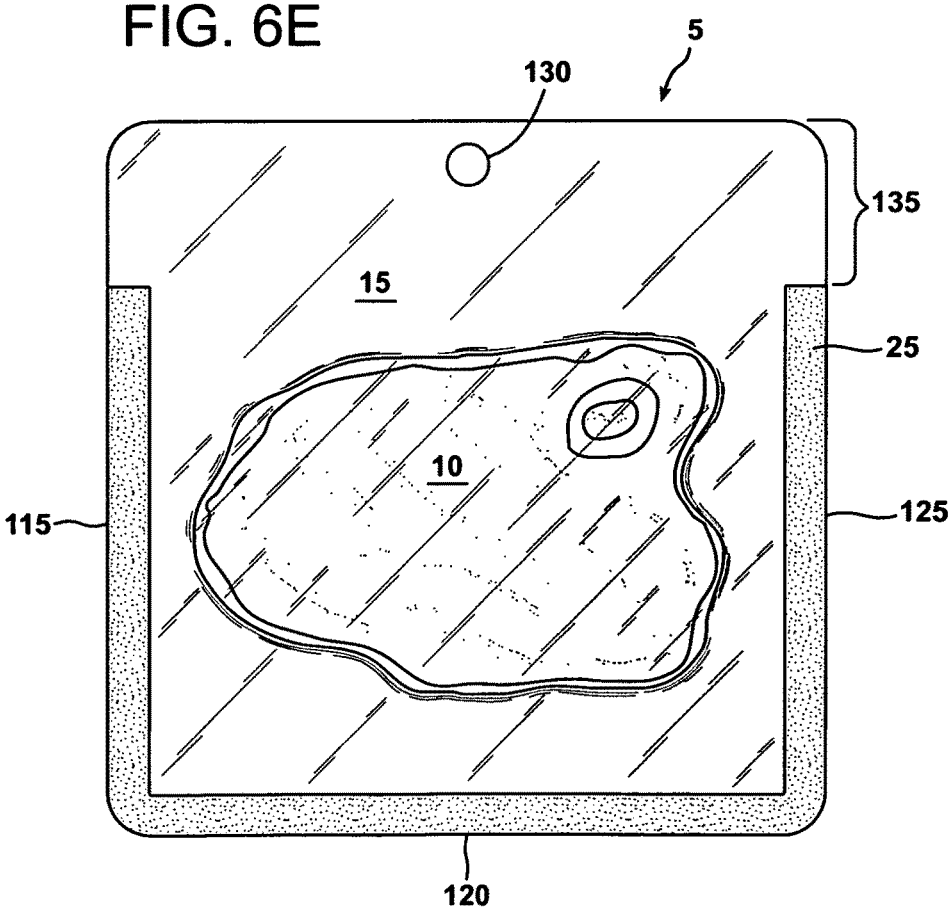
FIG. 6*e* is a top plan view of one embodiment of a frame configuration suitable for use with the presently disclosed subject matter.

To this end, although depicted as rectangular in shape in the Figures, frames 25, 30 can have any desired configuration or shape. For example, as depicted in FIGS. 6*a*-6*d*, frames 25, 30 can be square, circular, oval, or triangular, respectively. One of ordinary skill in the art would recognize that the shape of frames 25, 30 can include any of the wide variety of shapes known in the art and are not limited to the configurations set forth herein. To this end, in some embodiments, frames 25, 30 are not closed on all sides, as depicted in FIG. 6*e*. Specifically, product 10 is packaged between films 15, 20, which are clamped between frames 25, 30 on sides 115, 120, and 125. Films 15, 20 extend past the frames on the open side to form extension 135. Extension 135 can be configured to form support means 130, which can include (but is not limited to) a hanging means for display. These and other embodiments would be apparent to those of ordinary skill in the art after a review of the presently disclosed subject matter.

Frames 25, 30 can be constructed from any of a wide variety of rigid or semi-rigid materials, including (but not limited to) plastic, metal, wood, cardboard, chipboard, stiff paper, foamed plastics, recycled materials, compostable materials, heavy foil, and/or combinations of these materials to form composites. Thus, in some embodiments, frames 25, 30 can be constructed from any of a wide variety of plastic materials known in the art, including (but not limited to) foamed or solid polystyrene, crystallized polystyrene (CPS), polyethylene terephthalate (PET), polypropylene, polyethylene, or combinations thereof. Such materials are typically suitable for forming, yet stiff or rigid enough to resist buckling, folding, crumbling or collapsing due to compression when stacked or the jarring and bouncing of handling and shipping. Such materials can provide adequate rigidity to protect the packaged product 10 from side impact loads.

Although the suspension frames provide support and protect the packaged product from damage, in some embodiments, it can be desirable to additionally protect the articles from damage during shipping, handling, and the like. For example, article 5 can be packaged in any of a wide variety of containers known in the art that are adapted for packaging, storing, and/or shipping goods. Examples of such containers include (but are not limited to) corrugated containers, plastic containers, paper containers, cardboard boxes, and the like. Alternatively or in addition, in some embodiments, article 5 can be partially or fully surrounded by a protective plastic material, foam material, paper material, and/or bubble wrap. Such materials are well known to those of ordinary skill in the packaging art.

In some embodiments, frames 25 and/or 30 are constructed from a material that itself provides a barrier to the passage of oxygen, e.g., vinylidene chloride copolymer, nylon, polyethylene terephthalate, ethylene/vinyl alcohol copolymer, and the like. In some embodiments, the material(s) from which frames 25 and/or 30 are constructed can comprise an oxygen scavenging material, such as (but not limited to) Amisorb®. Alternatively or in addition, frames 25 and/or 30 can comprise a substantially gas-impermeable sealant film laminated or otherwise bonded to the inner or outer surface thereof. In some embodiments, frames 25 and/or 30 have an oxygen transmission rate of no more than 10 cc/m$^2$/24 hr at 25° C., 0% RH, 1 atm (ASTM D 3985).

In some embodiments, frames 25 and/or 30 can comprise a hole therethrough covered by a label, wherein the label can be removed to initiate on demand blooming. Specifically, at a desired time, a user can remove the label to expose the hole in the frame to the outside environment, allowing the influx of oxygen. The label can be attached to the frame(s) by any of a wide variety of means known to those of ordinary skill in the art, including (but not limited to) adhesive. Further, the hole can be any of a wide variety of recesses, including slits and the like.

In some embodiments, frames 25, 30 can be constructed from a material that can be recycled, making it possible to reuse the frames in construction of new frames or other materials. It is also within the scope of the presently disclosed subject matter that the frames can be reused or remanufactured to create new articles.

Figure 7:
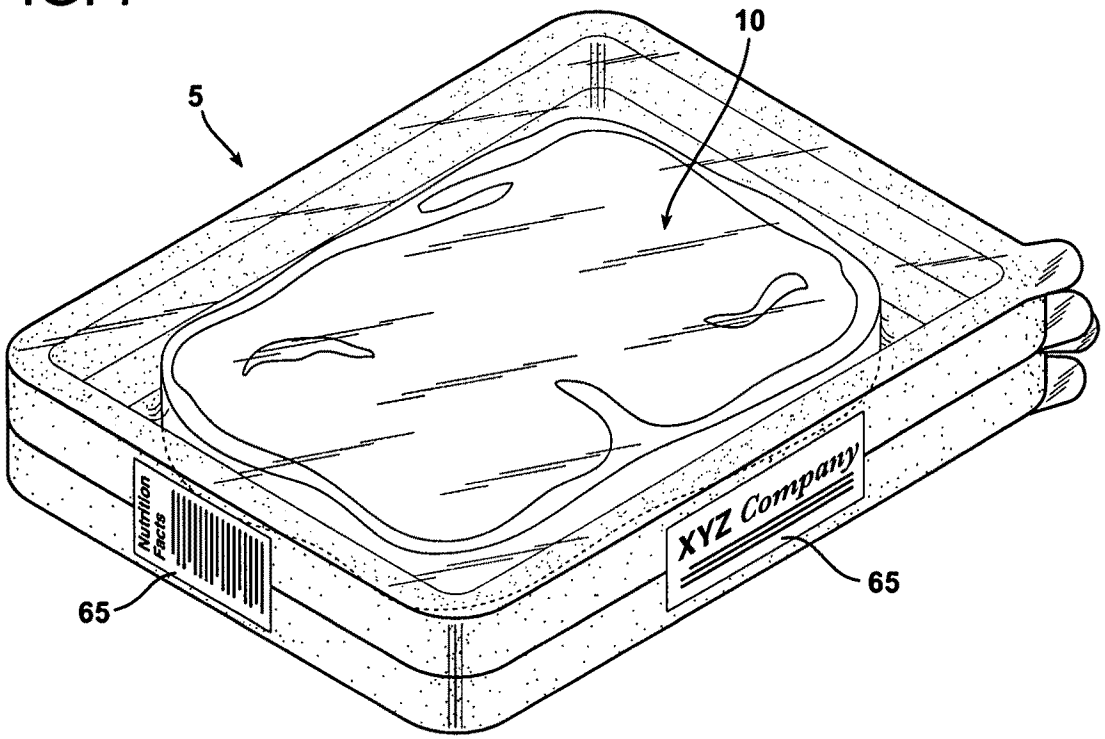
FIG. 7 is a perspective view of one embodiment of the disclosed article.

Graphics and/or labels can be applied to frames 25 and/or 30 as desired. For example, FIG. 7 depicts article 5 comprising labels 65 adhered thereto. Thus, in some embodiments, the label can be preprinted and applied to the article to provide advertising information, "use by" date, expiration date, and the like. The labels can be printed or adhered to frames 25 and/or 30 (and/or to films 15, 20, and/or to an oxygen-impermeable material) by any suitable printing process, including (but not limited to) ink jet, flexographic, rotogravure, or the like.

In some embodiments, upper and lower frames 25, 30 can be fabricated from a sheet or web that is thermoformed to produce an article of desired shape.

Thermoforming is well known in the packaging art, and is the process whereby a thermoplastic web is heat softened and reshaped to conform to the shape of a cavity in a mold. Suitable thermoforming methods, for example, include a vacuum forming or plug-assist vacuum forming method. In a vacuum forming method, the first web is heated, for example, by a contact heater, and a vacuum is applied beneath the web causing the web to be pushed by atmospheric pressure down into a pre-formed mold. In a plug-assist vacuum forming method, after the first or forming web has been heated and sealed across a mold cavity, a plug shape similar to the mold shape impinges on the forming web and, upon the application of vacuum, the forming web transfers to the mold surface.

Alternatively, in some embodiments, upper and lower frames 25, 30 can be formed using any known extrusion process by melting the component polymer(s) and extruding, coextruding, or extrusion-coating them through one or more flat or annular dies. For example, in some embodiments, the frame can be correctly profiled to a pipe corrugation finishing line. Such extrusion methods would be known to those of ordinary skill in the art.

Although the frames depicted in the enclosed Figures depict only one compartment to house product 10, the presently disclosed subject matter can also include frames formed with one or more compartments to house a plurality of products.

III.D. Outer Oxygen-Impermeable Material

As set forth above, product 10 is initially packaged in upper and lower films 15, 20 wherein at least one of the films is oxygen-permeable. In order to prevent premature blooming of product 10, the oxygen-permeable film(s) must be protected from the outside environment by an outer oxygen-impermeable material until blooming is desired. In some embodiments, the oxygen impermeable material can comprise an overwrap film, a film applied on one or both sides of frames 25, 30, and/or a bag.

The oxygen-impermeable material can be used to cover oxygen-permeable film 15 and/or 20. The phrase "cover said oxygen-permeable film 15 and/or 20" as used herein can be broadly construed. Specifically, in embodiments wherein the oxygen-impermeable material is an overwrap, the overwrap can be positioned over only films 15 and/or 20 or over the entire frame and suspended product assembly to provide protection from oxygen in the outside environment. In embodiments wherein the oxygen-impermeable material comprises a bag, films 15 and/or 20 can be covered by the oxygen-impermeable material by placing the suspended product and frame assembly within the bag. Similarly, in embodiments wherein said oxygen-impermeable material comprises a lid film, the lid film can be attached to an outer face of the frame, as set forth below.

The outer oxygen-impermeable material can be any suitable film or laminate that is substantially impermeable to gas (such as oxygen). Suitable polymeric materials having gas barrier properties for use in the presently disclosed subject matter include (but are not limited to) polyester, nylon, cellophane, polypropylene, polyvinyl acetate, saran, ethylene vinyl alcohol copolymers, vinylidene chloride copolymers (PVDC) such as vinylidene chloride vinyl chloride or vinylidene chloride methyl acrylate, or combinations of the aforementioned materials with each other or in further combination with polyethylene, ethylene vinyl acetate (EVA) copolymer, ionomer, or coextrusions involving two or more of the aforementioned polymeric materials. A representative oxygen-impermeable film can include: Nylon/PVDC//EVA/LLDPE/seal, wherein the double slashes (//) indicate adhesive lamination of the two webs, although a variety of laminates and multilayer films can be employed as the impermeable web of the presently disclosed subject matter.

In some embodiments, the outer oxygen-impermeable material can have oxygen permeability of less than 500 $cm^3$ $O_2/m^2 \cdot day \cdot atm$; in some embodiments, less than 100 $cm^3$ $O_2/m^2 \cdot day \cdot atm$; in some embodiments, less than 50 $cm^3$ $O_2/m^2 \cdot day \cdot atm$; in some embodiments, less than 25 $cm^3$ $O_2/m^2 \cdot day \cdot atm$; in some embodiments, less than 10 $cm^3$ $O_2/m^2 \cdot day \cdot atm$; in some embodiments, less than 5 $cm^3$ $O_2/m^2 \cdot day \cdot atm$; and in some embodiments, less than 1 $cm^3$ $O_2/m^2 \cdot day \cdot atm$ (tested at 1 mil thick and at 25° C. in accordance with ASTM D3985).

Thus, the outer oxygen-impermeable material can be provided in sheet or film form and can comprise any of the films commonly used for the disclosed type of packaging. Accordingly, the outer oxygen-impermeable material can additionally comprise one or more seal layers, tie layers, abuse layers, and/or bulk layers, as would be apparent to those of ordinary skill in the art. The polymer components used to fabricate the outer oxygen-impermeable material according to the presently disclosed subject matter can also comprise appropriate amounts of other additives normally included in such compositions. For example, slip agents (such as talc), antioxidants, fillers, dyes, pigments and dyes, radiation stabilizers, antistatic agents, elastomers, and the like can be added to the disclosed films.

Generally, the outer oxygen-impermeable material can be multilayer or monolayer. Typically, however, it will have two or more layers to incorporate a variety of properties, such as, for example, sealability, gas impermeability, and toughness into a single film. Thus, in some embodiments, the outer oxygen-impermeable material comprises a total of from about 4 to about 20 layers; in some embodiments, from about 4 to about 12 layers; and in some embodiments, from about 5 to about 9 layers. Accordingly, the disclosed film can comprise 1, 2, 3, 4, 5, 6, 7, 8, 9, 10, 11, 12, 13, 14, 15, 16, 17, 18, 19, or 20 layers. One of ordinary skill in the art would also recognize that the disclosed material can comprise more than 20 layers, such as in embodiments comprising microlayering technology.

Outer oxygen-impermeable material can have any total thickness desired, so long as it provides the desired properties for the particular packaging operation in which the film is used, e.g., optics, modulus, seal strength, and the like. Final web thicknesses can vary, depending on process, end use application, and the like. Typical thicknesses can range from about 0.1 to 20 mils; in some embodiments, about 0.3 to 15 mils; in some embodiments, about 0.5 to 10 mils; in some embodiments, about 1 to 8 mils; in some embodiments, about 1 to 4 mils; and in some embodiments, about 1 to 2 mils.

In some embodiments, the outer oxygen-impermeable material can be transparent (at least in the non-printed regions) such that product 10 is visible through the films.

The outer oxygen-impermeable material can be constructed by any suitable process known to those of ordinary skill in the art, including (but not limited to) coextrusion, lamination, extrusion coating, and combinations thereof.

Figure 8A:
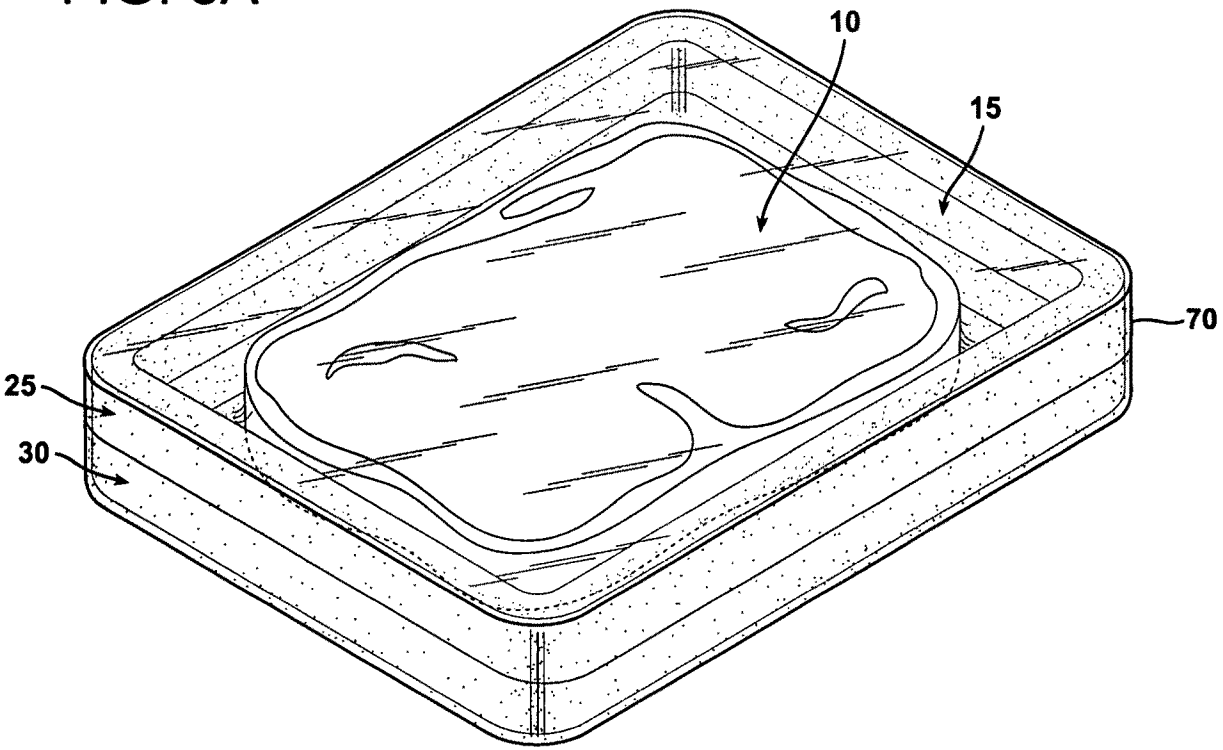
FIG. 8*a* is a perspective view of one embodiment of the disclosed article comprising an overwrap.

FIG. 8*a* illustrates article 5 comprising oxygen-impermeable overwrap 70. Particularly, overwrap 70 can be used as a transparent wrap to cover and secure the suspended product and frame assembly. The overwrap can be adapted for use as a complete package overwrap—namely, where the film is capable of completely covering the frames and suspended product assembly and adhering or clinging to itself to provide a complete barrier to prevent oxygen from permeating into the article. The oxygen-impermeable overwrap can then be removed at a desired time to promote blooming.

Figure 8B:
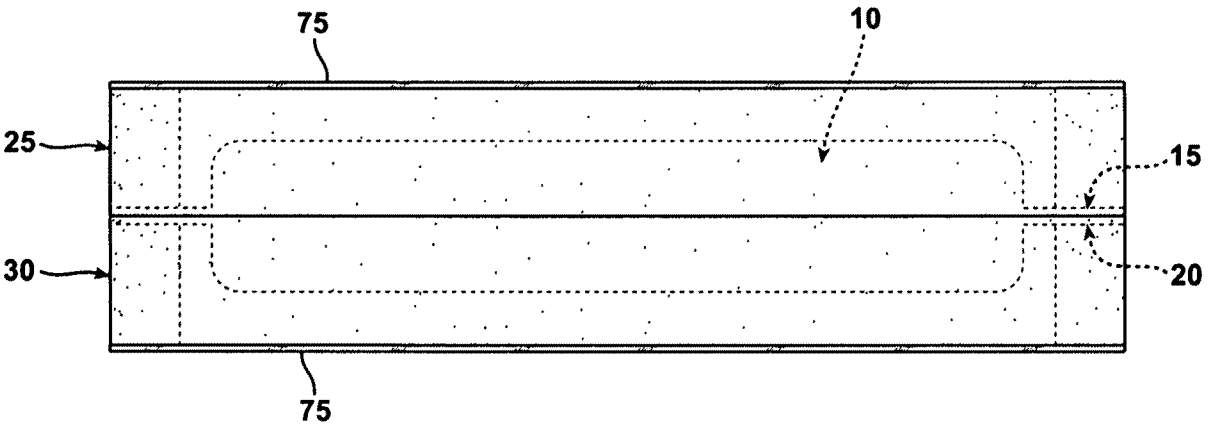
FIG. 8*b* is a front elevation view of one embodiment of the disclosed article comprising two outer films.
Figure 8C:
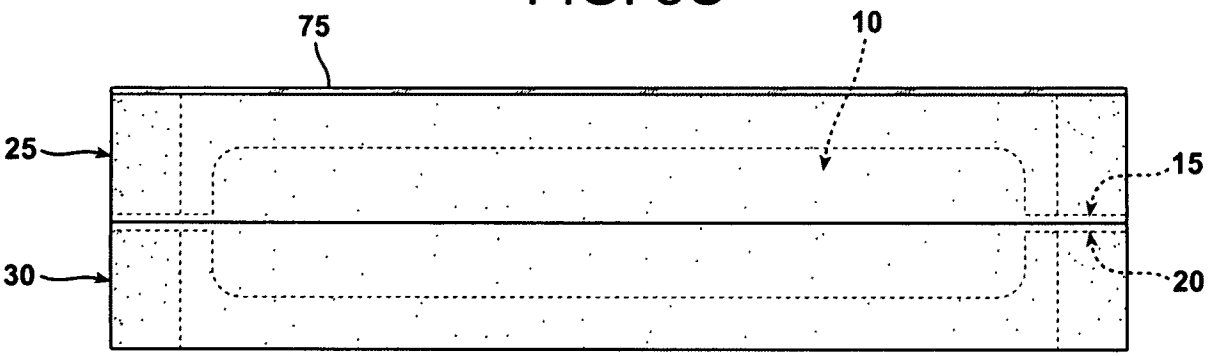
FIG. 8*c* is a front elevation view of one embodiment of the disclosed article comprising an outer film.

In addition, in some embodiments, the outer oxygen-impermeable material can comprise oxygen-impermeable lid film 75 sealed or adhered to an outer side of one or both frames 25, 30. Specifically, in embodiments wherein both upper and lower films 15, 20 are oxygen-permeable, oxygen-impermeable lid film 75 can be adhered or sealed to the top surface of upper frame 25 and/or the bottom surface of lower frame 30 (i.e., frame surfaces furthest away from product 10), as depicted in FIG. 8*b*. In embodiments wherein only one of upper and lower films 15, 20 is oxygen-permeable, oxygen-impermeable lid film 75 can be adhered or sealed to the outer surface of only one frame to prevent the article from prematurely blooming. For example, in embodiments wherein upper film 15 is oxygen-permeable and lower film 20 is oxygen-impermeable, oxygen-impermeable lid film 75 can be sealed or adhered to the top surface of upper frame 25, as depicted in FIG. 8*c*.

Figure 8D:
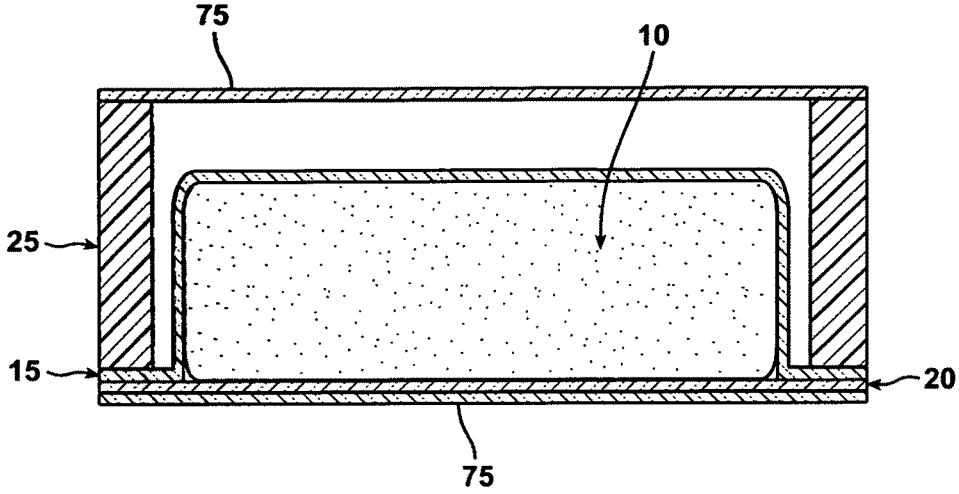
FIG. 8*d* is a front elevation view of one embodiment of the disclosed article comprising two outer films.
Figure 8E:
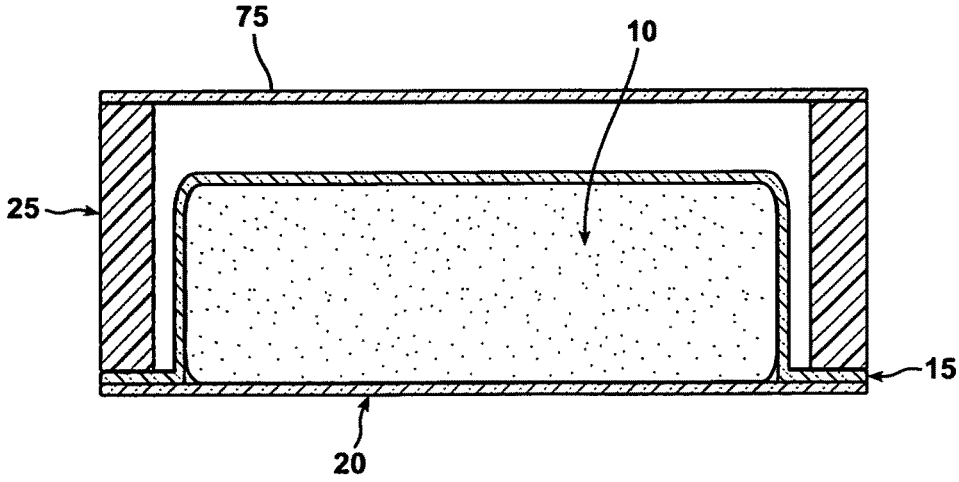
FIG. 8*e* is a front elevation view of one embodiment of the disclosed article comprising an outer film.

Similarly, in embodiments wherein only a single frame is used, oxygen-impermeable lid film 75 can be sealed to the top surface of the frame and/or to lower film 20, as depicted in FIGS. 8*d* and 8*e*, respectively. To elaborate, in embodiments wherein both upper and lower films 15, 20 are oxygen-permeable, article 5 can comprise oxygen-impermeable lid film 75 adhered or sealed to the top surface of frame 25 and to lower film 20, as illustrated in FIG. 8*d*. As depicted in FIG. 8*e*, in embodiments wherein upper film 15 is oxygen-permeable and lower film 20 is oxygen-impermeable, article 5 can comprise oxygen-impermeable lid film 75 adhered to the top surface of frame 25. At the retail outlet, oxygen-impermeable lid film 75 can be peeled from the frame(s) to promote blooming due to the exchange with atmospheric oxygen, or holes can be incorporated in films 15 and/or 20 to allow blooming of both sides after peeling of just one oxygen-impermeable lid film 75.

Figure 8F:
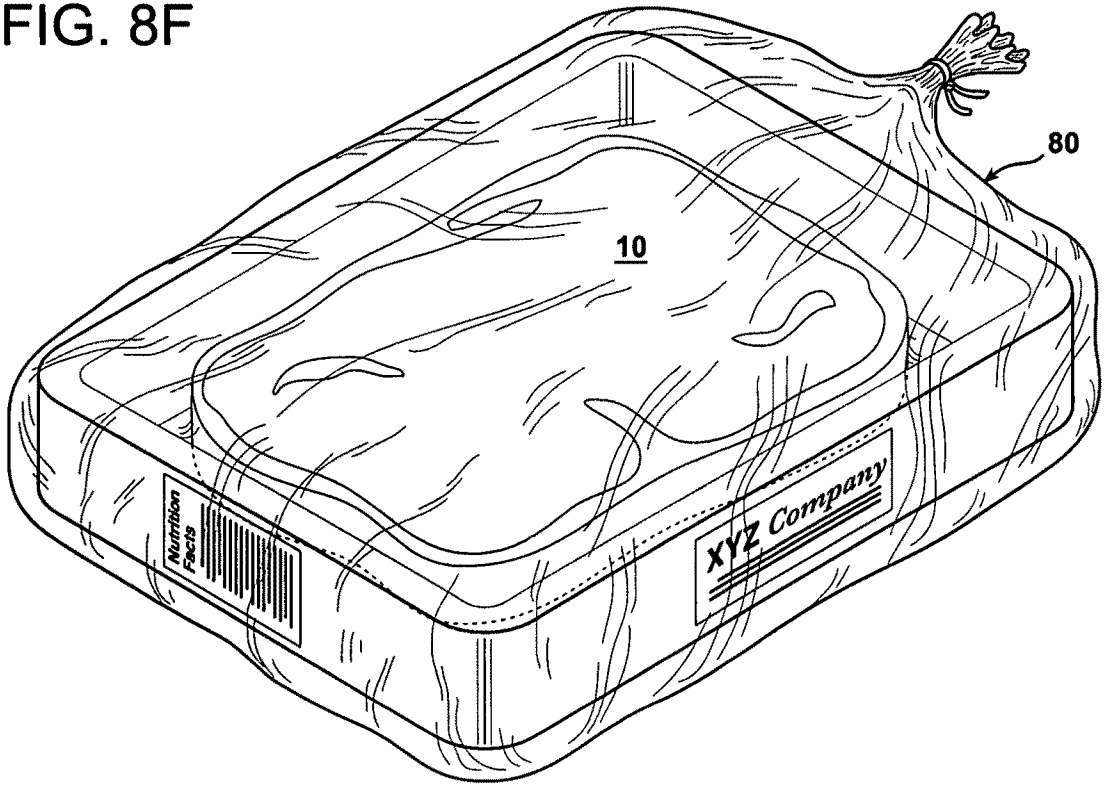
FIG. 8*f* is a perspective view of one embodiment of the disclosed article comprising a bag.

Further, in some embodiments, outer oxygen-impermeable material can comprise bag 80. Specifically, FIG. 8*f* illustrates that the suspended product and frame assembly (i.e., as illustrated in FIGS. 3*b* and 4*b*) can be positioned within oxygen-impermeable bag 80, and the bag then secured closed. At the time of desired blooming of product 10, the suspended product and frame assembly can be removed from bag 80 to allow oxygen to enter permeable film 15 and/or 20 and contact product 10.

IV. Manufacture of Article 5

IV.A. Vacuum Skin Packaging

As depicted in FIG. 3*a*, in some embodiments, both upper and lower films 15, 20 are formed around product 10 by vacuum or differential air pressure such that the product is packaged under vacuum. Vacuum skin packaging is a well known process in the packaging art that uses thermoplastic packaging material to enclose a product. The vacuum skin packaging process is in one sense a type of thermoforming process in which the product to be packaged serves as the mold for the thermoform. In the embodiment depicted in FIG. 3*a*, thermoformable material can be used as both the top film and bottom film in conjunction with an intermediate support for products held on either side of the support. See, for example, U.S. Pat. No. 3,966,045 to Perdue; U.S. Pat. No. 6,042,913 to Miranda et al.; U.S. Pat. No. 5,979,653 to Owens et al.; U.S. Pat. No. 5,770,287 to Miranda et al.; U.S. Pat. Nos. 5,346,735; 5,087,462 to Bekele et al.; U.S. Pat. No. 5,076,436 to Bortolani et al.; U.S. Pat. No. 5,048,268 to Brembilla et al.; U.S. Pat. No. 4,812,320 to Ruzek; U.S. Pat. No. 3,835,618 to Perdue; U.S. Pat. No. 3,950,919 to Perdue; and U.S. Pat. No. 4,611,456 to Gillio-tos et al., the entire disclosures of which are incorporated by reference herein.

Alternatively, as depicted in FIG. 4*a*, in some embodiments, product 10 can be positioned on bottom film 20, and top film 15 then vacuum sealed over the top of the product and bottom film 20. Particularly, product 10 is placed on the bottom film, which in some embodiments can be rigid or semi-rigid support member that can be flat or shaped. The supported product is then passed to a chamber where top film 15 (which can be a polymeric film or laminate) is drawn upward against a heated dome and softened. The softened top film is then draped over product 10. The movement of top film 15 is controlled by vacuum and/or air pressure, and the interior of the article is vacuumized before final welding of the top film to the bottom film. The heated top film thus forms a tight skin around product 10 and is sealed to bottom film 20. Product 10 is thus packaged under vacuum, and the space containing product 10 is evacuated from gases.

Figure 9B:
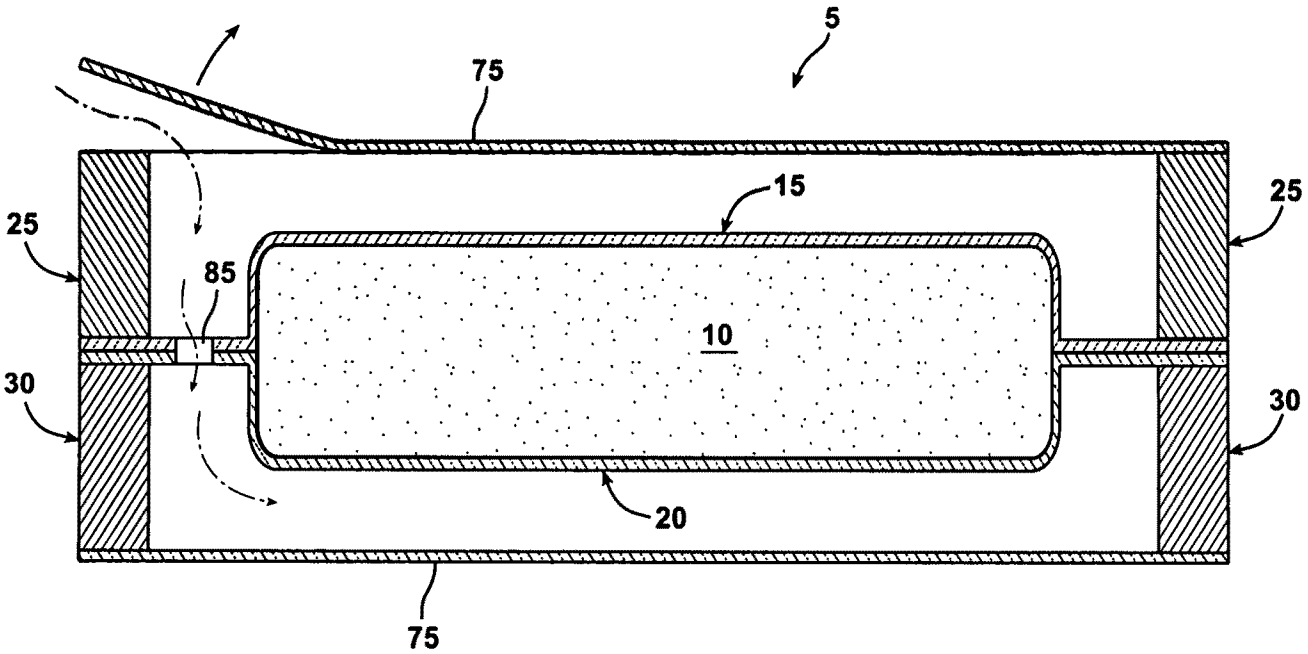
FIGS. 9*b* and 9*c* are front elevation views of two embodiments of the disclosed article.
Figure 9C:
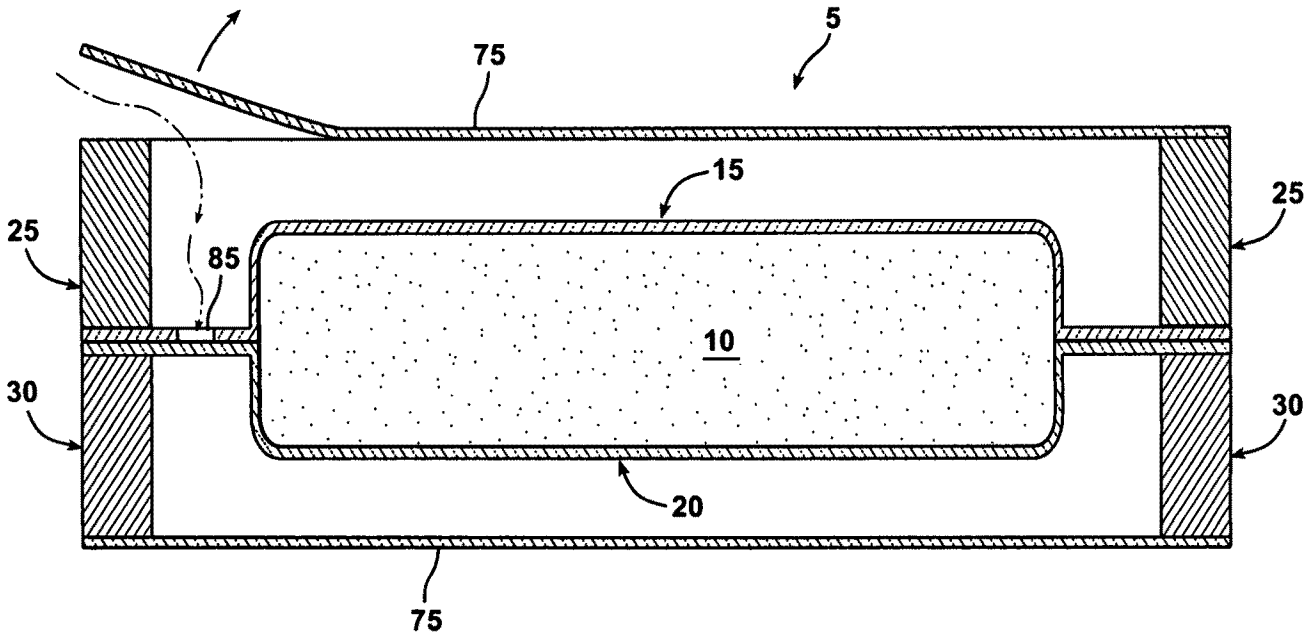

In some embodiments, after upper and lower films 15, 20 have been packaged around product 10, one or more holes can be formed into the films. For example, FIG. 9*a* illustrates films 15, 20 comprising a plurality of holes to allow communication between the films after application of frames 25, 30 and outer oxygen-impermeable material. Thus, in embodiments wherein both upper and lower films 15, 20 are oxygen-permeable, holes 85 can facilitate communication between the films to promote faster blooming. Holes 85 can span both upper and lower films 15, 20, as depicted in FIG. 9*b*, or can span only one of the films, as depicted in FIG. 9*c*.

IV.D.ii Frame Assembly

After upper and lower films 15, 20 are packaged around product 10, the frames are then assembled. As depicted in FIGS. 3*a* and 3*b*, in some embodiments article 5 comprises upper and lower frames 25, 30. Specifically, FIGS. 3*b*-3*d* illustrate upper and lower frames 25, 30 packaged around the sealed product of FIG. 3*a*. Upper and lower films 15, 20 are clamped in between upper and lower frames 25, 30. Frames 25, 30 can be held together using any of a wide variety of methods known to those of ordinary skill in the art, including (but not limited to) adhesive, mechanical closures, and/or an interlocking mechanism. Specifically, the interlocking mechanism can comprise a simple male/female interlocking cut out, where the cut out of smaller dimension fits tightly into the larger dimension cut out. Similar designs can incorporate snap fittings and/or a male/female groove fitting to allow the frame pieces to stay firmly attached. For example, in some embodiments, one or both interlocking members can have an undercut cross-section that snaps into an appropriate undercut on the matching member. Such fittings are well known to those of ordinary skill in the packaging art.

In some embodiments, any excess film that extends past the frames is removed using methods known to those of ordinary skill in the art, such as (but not limited to) an edge trimming procedure. For example, in some embodiments, the film that extends beyond the inner portion of the frame is cut and removed from the package before the additional frame member is affixed, resulting in a package with no film extending beyond the outer surface of the frame members. After assembly of upper and lower frames 25, 30, product 10 is then suspended between the frames.

As depicted in FIGS. 4*a* and 4*b*, in some embodiments, article 5 comprises a single frame. Particularly, FIGS. 4*b*-4*d* illustrate frame 25 packaged around the sealed product. In these Figures, upper film 15 is sealed to one edge of the frame using any of a wide variety of methods known to those of ordinary skill in the art, including (but not limited to) adhesive and/or heat sealing. In some embodiments, any excess film that extends past frame 25 is removed using methods known to those of ordinary skill in the art, such as (but not limited to) an edge trimming procedure.

IV.D.iii Barrier Application

Because at least one of upper and/or lower films 15, 20 is oxygen-permeable, article 5 requires the application of an oxygen-impermeable material to prevent oxygen from contacting product 10 until a desired time. As set forth in detail herein above, the oxygen-impermeable material can be in the form of an oxygen-impermeable overwrap, an oxygen-impermeable lid film applied to at least one side of the frame or frames, and/or an oxygen-impermeable bag. Alternatively or in addition, a stacking mechanism can be used.

Thus, in some embodiments, the barrier application can comprise applying an oxygen-impermeable overwrap to all or a portion of article 5. As depicted in FIG. 8*a*, oxygen-impermeable overwrap 70 can be wrapped on all sides of the frame(s) to provide a barrier to the influx of oxygen into the interior of the article. Thus, the oxygen-impermeable overwrap prevents oxygen from permeating oxygen-permeable films 15 and/or 20. Barrier overwrap 70 is capable of completely covering the frame(s) and adhering or clinging to itself or to the frame(s) to complete the packaging closure. Alternatively, in some embodiments, the barrier overwrap can be adhered, sealed, or can cling to one or both frames. In some embodiments, the barrier overwrap can be pressed into a heated plate to weld together the folds of the film at a desired location. Such overwrapped films are well known in the packaging art. See, for example, U.S. Pat. No. 6,408,598 to Stockley; U.S. Pat. No. 5,663,002 to Schirmer; U.S. Pat. No. 4,759,444 to Barmore; U.S. Pat. No. 5,018,623 to Hrenyo; and U.S. Pat. No. 5,503,858 to Reskow, the entire disclosures of which are incorporated herein by reference. In some embodiments, the interior space between overwrap 70 and films 15, 20 can be evacuated of normal atmosphere and flushed with a preservation-enhancing gas (such as, for example, $CO_2$).

In some embodiments, the barrier application can comprise an oxygen-impermeable lid film applied to an outer side of at least one frame 25, 30. For example, FIG. 8*b* depicts oxygen-impermeable lid film 75 applied to both the top surface of upper frame 25 (i.e., the frame surface not in contact with upper film 15) and the bottom surface of lower frame 30 (i.e., the surface not in contact with lower film 20). In these embodiments, upper and/or lower films 15, 20 can be oxygen-permeable, such that oxygen-impermeable lid film 75 provides a barrier to prevent the passage of oxygen into the article. FIG. 8*c* illustrates oxygen-impermeable lid film 75 applied to the top surface of upper frame 25. In these embodiments, upper film 15 can be oxygen-permeable, and lower film 20 can be oxygen-impermeable, such that oxygen-impermeable lid film 75 is not needed on lower frame 30 to prevent oxygen from flowing into the article. However, the presently disclosed subject matter also includes such embodiments wherein oxygen-impermeable lid film 75 applied to lower frame 30.

Similarly, FIGS. 8*d* and 8*e* illustrate oxygen-impermeable lid film 75 applied to the top surface of single frame 25 (i.e., the surface not in contact with upper and lower films 15, 20). Oxygen-impermeable lid film 75 can be attached to the frame using any of a wide variety of methods known to those of ordinary skill in the art, including (but not limited to) adhesive and/or heat sealing. In some embodiments, the interior space between upper film 15 and oxygen-impermeable lid film 75 and/or the interior space between lower film 20 and oxygen-impermeable lid film 75 can be evacuated of normal atmosphere and flushed with a preservation-enhancing gas (such as, for example, $CO_2$).

In some embodiments, the barrier application can be a bag structure (i.e., mother bag) such that product 10, films 15, 20, and the frame(s) are completely enclosed and sealed within the bag. As depicted in FIG. 8*f*, the packaged product and frame structure can be placed within oxygen-impermeable bag 80. Bag 80 can be constructed from an oxygen-impermeable material that is essentially impervious to oxygen. The bag can then be sealed to prevent the influx of oxygen from the ambient atmosphere into article 5. In some embodiments, bag 80 can be evacuated of normal atmosphere and flushed with a preservation-enhancing gas (such as, for example, a mixture of gases comprising about 30% carbon dioxide ($CO_2$) and about 70% nitrogen ($N_2$)). Such bags are known to those of ordinary skill in the packaging art. See, for example, U.S. Pat. No. 6,716,499 to Vadhar; U.S. Pat. No. 6,544,660 to Lind; U.S. Pat. No. 4,755,402 to Oberle; and U.S. Pat. No. 4,716,061 to Winter, the entire disclosures of which are incorporated herein by reference.

Alternatively or in addition, in some embodiments, bag 80 can be evacuated of normal atmosphere and then flushed with a gas mixture comprising carbon monoxide (CO). Carbon monoxide binds to myoglobin in the meat tissue to preserve and maintain a bright red color and to present a fresh and healthy appearance to the meat. In some embodiments, the range of carbon monoxide in the gas mixture can be from about 1 to 10% (by volume) CO; in some embodiments, from 0.1 to 5% CO; in some embodiments, about 4.5% or less of CO. The remainder of the gas mixture can be a preservation-enhancing gas, such as $CO_2$ and/or $N_2$, as would be known to those of ordinary skill in the art. In these embodiments, when bag 80 is removed, the CO escapes from the package, allowing the natural aging of the meat as a result of exposure to atmospheric oxygen.

In some embodiments, article 5 can comprise a barrier to oxygen through the use of a stacking mechanism. For example, as depicted in FIG. 10*a*, in some embodiments, article 5 can be arranged in stack 100 to provide a barrier to the outside environment. Particularly, the frames on each article can be constructed to interlock with each other. The bottom article can rest on base 90 constructed from an oxygen-impermeable material. Base 90 can be rigid or semi-rigid and can support the weight of stack 100. One of ordinary skill in the art would recognize that base 90 is optional and that the presently disclosed subject matter includes embodiments without base 90.

Figure 10B:
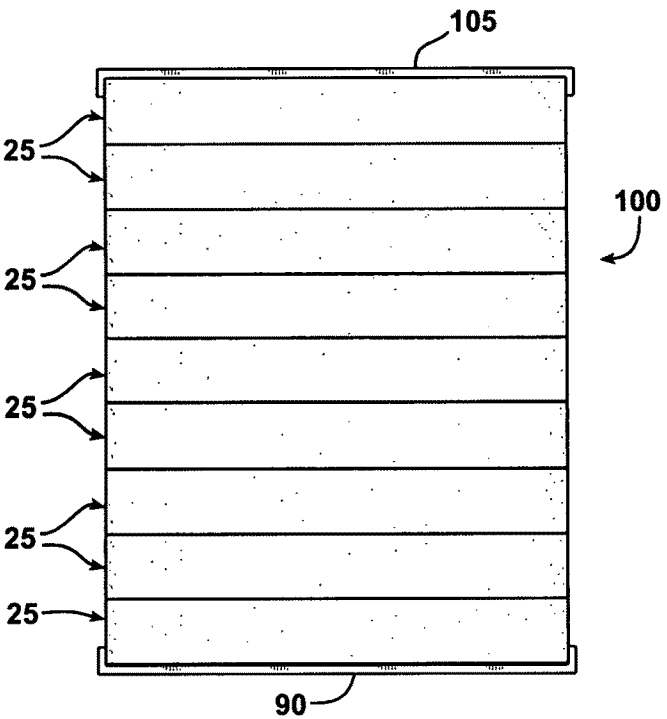

Because base 90 and frames 25, 30 are oxygen-impermeable, they provide a barrier to the influx of oxygen. To prevent oxygen from entering stack 100 through the top of the stack, an oxygen-impermeable lid can be used. For example, as depicted in FIG. 10*b*, stack 100 can comprise lid 105 constructed from an oxygen-impermeable material. Lid 105 can be configured in any suitable shape or size, so long as it provides an air-tight barrier to prevent exposure of the articles to the outside environment. One of ordinary skill in the art would recognize that lid 105 is optional and that the presently disclosed subject matter includes embodiments lacking such a feature.

Figure 10E:
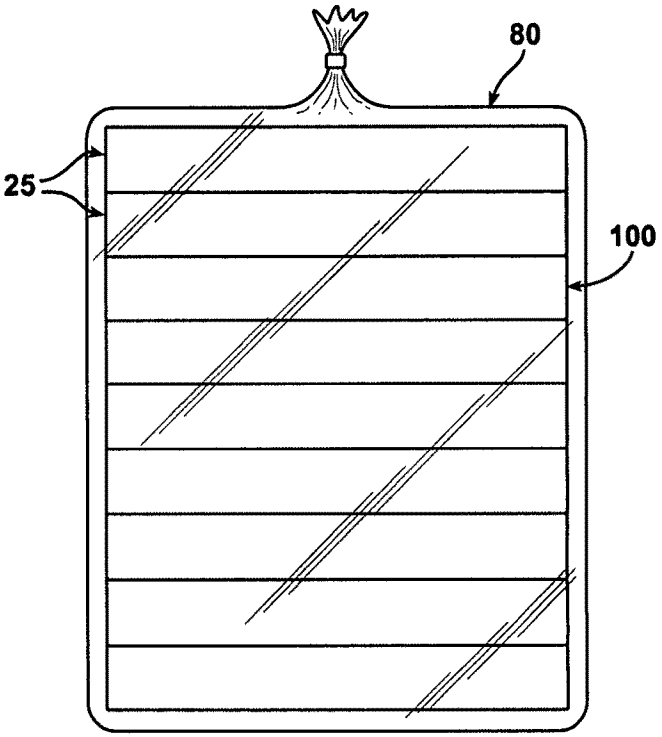
Figure 10D:
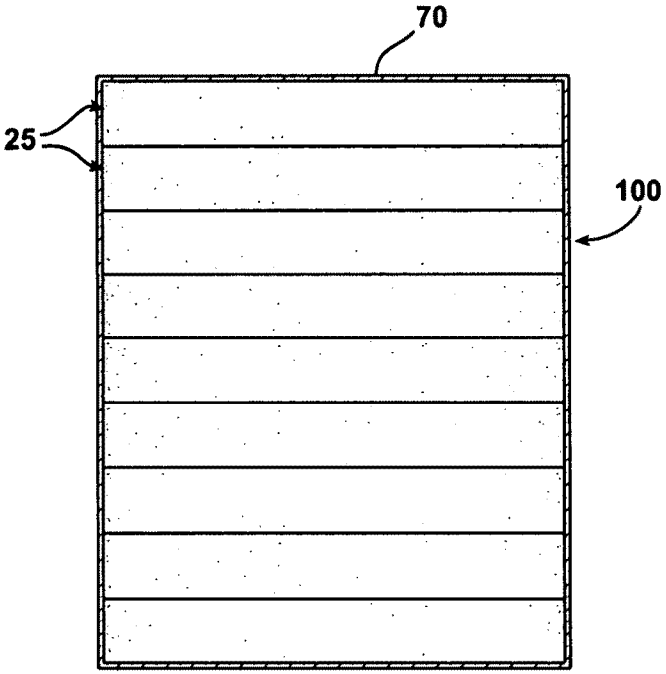

Alternatively or in addition to lid 105 and/or base 90, each article 5 can comprise oxygen-impermeable lid film 75 adhered to the top and/or bottom surface of each article, as depicted in FIG. 10*c*. Alternatively or in addition, stack 100 can be packaged in oxygen-impermeable overwrap 70 (as depicted in FIG. 10*d*) and/or oxygen-impermeable bag 80 (as depicted in FIG. 10*e*), as discussed above with respect to individual articles 5. In some embodiments, stack 100 can be evacuated of normal atmosphere and flushed with a preservation-enhancing gas (such as, for example, $CO_2$, CO, and/or NO).

Thus, in some embodiments, article 5 can be a modified atmosphere package ("MAP"), wherein product 10 is maintained in a sealed container containing an interior space with an atmosphere that is different than ambient air. Particularly, in MAP packaging, prior to providing a barrier to the article, air is evacuated from the interior of the article and replaced by a gas that differs from ambient air. For example, fresh meat and other food products can be packaged in a low-oxygen environment (e.g., high levels of carbon dioxide and/or nitrogen) after evacuating all or most of the air from the article. Such MAP systems are well known to those of ordinary skill in the art. Examples of such MAP packaging are disclosed in U.S. Pat. No. 5,686,126 to Noel et al. and U.S. Pat. No. 5,779,050 to Kocher et al., the entire disclosures of which are hereby incorporated by reference.

Thus, in some embodiments, the oxygen level within article 5 can be reduced to a first level in the range less than 0.5% and in some embodiments less than 0.05%. The reduction in oxygen level can be accomplished using one or more techniques, including (but not limited to) evacuation, gas flushing, and/or oxygen scavenging. Such methods are well known to those of ordinary skill in the packaging art. For example, during a gas flushing process, an appropriate mixture of gases is introduced into the cavity of article 5 to create a modified atmosphere therein.

Article 5 is then sealed using one of the barrier methods discussed herein above (i.e., oxygen-impermeable overwrap 70, oxygen-impermeable film 75, and/or oxygen-impermeable bag 80) to provide an airtight, sealed container containing a low-oxygen atmosphere. Thus, when product 10 comprises a red meat product, the cut of meat within the modified atmosphere package takes on a purple-red color when the oxygen is removed from the interior of article 5. The modified article can then be stored in a refrigeration unit for several weeks prior to being offered for sale at a retail establishment. It should be noted that the presently disclosed subject matter comprises embodiments wherein article 5 is not a modified atmosphere package and the interior of the article comprises ambient air.

V. Methods of Using the Disclosed Suspension Article

The presently disclosed subject matter is directed to an article comprising a product to be initially stored until a higher oxygen concentration environment is desired for blooming product 10. In some embodiments, article 5 is suitable for display at a retail establishment for purchase by a consumer. Thus, article 5 can be produced at a central processing facility for subsequent distribution to retail outlets (such as butcher shops, grocery stores, and the like). To this end, in some embodiments, article 5 can contain a case-ready product comprising fresh red meat. Case-ready meat products can be generally defined as fresh meat that is pre-packaged and optionally pre-labeled at a centralized location and delivered to the retail market prepared for final sale.

In the embodiments set forth herein, product 10 is packaged between films 15, 20, wherein at least one of the films is oxygen-permeable to allow oxygen to contact product 10 at a desired time. Accordingly, upper film 15, lower film 20, or both upper and lower films 15, 20 can be oxygen-permeable. Thus, in some embodiments, upper film 15 or lower film 20 can be oxygen-impermeable. In embodiments wherein both upper and lower films 15, 20 are oxygen-permeable, article 5 can be at least partially covered by oxygen-impermeable lid film 75, oxygen-impermeable overwrap 70, and/or oxygen-impermeable bag 80 to prevent premature blooming of product 10, as depicted in FIGS. 8*a*-8*f*. In some embodiments, article 5 can be assembled in a stacking arrangement to prevent premature blooming of product 10, as depicted in FIGS. 10*a*-10*e*.

At any desired time, blooming can be initiated. For example, in embodiments wherein article 5 is wrapped in oxygen-impermeable overwrap 70, a user would simply remove the overwrap using methods known in the art, including (but not limited to) manually or mechanically unwrapping the overwrap from article 5, manually or mechanically cutting the overwrap from the article, and the like. Once the oxygen-impermeable overwrap is removed from article 5, oxygen can then enter the article through oxygen-permeable film 15 and/or 20 to bloom product 10.

Similarly, in embodiments wherein article 5 is packaged within oxygen-impermeable bag 80, at the time of desired blooming, a user can simply remove article 5 from the bag using methods known in the art, including (but not limited to) cutting, piercing, or unsealing the bag and then removing article 5 therefrom. Oxygen can then enter the article through oxygen-permeable film 15 and/or 20 and thus bloom product 10.

Continuing, in embodiments wherein article 5 comprises oxygen-impermeable lid film 75 sealed to upper and/or lower frames 25, 30, at the time blooming is desired, a user can simply peel away the lid film(s) from the frames using a cutting device (scissors, a knife, and the like) or using a simple peeling action. To this end, in some embodiments, article 5 can comprise an easy open feature, such as tab 96, depicted in FIG. 5*c*. In use, one would merely peel tab 96 to separate lid film 75 from the frame. One of ordinary skill in the art would recognize that any of a number of suitable opening means can be included within the presently disclosed subject matter. For example, ring pull tabs, zippers, and the like can be used. See, for example, U.S. Pat. No. 7,419,301 to Schneider et al.; U.S. Pat. No. 7,395,642 to Plourde et al.; U.S. Pat. No. 7,322,920 to Johnson; U.S. Pat. No. 7,261,468 to Schneider et al.; U.S. Pat. No. 6,539,691 to Beer; U.S. Pat. No. 5,121,997 to La Pierre et al.; U.S. Pat. No. 5,100,246 to La Pierre et al.; U.S. Pat. No. 5,077,064 to Hustad et al.; U.S. Pat. No. 5,022,530 to Zieke; U.S. Pat. No. 6,976,588 to Wischusen et al.; U.S. Pat. No. 5,865,335 to Farrell et al.; U.S. Pat. No. 5,332,150 to Poirier; U.S. Pat. No. 4,778,059 to Martin et al.; and U.S. Pat. No. 4,680,340 to Oreglia et al., the entire disclosures of which are incorporated herein by reference. One of ordinary skill in the art would recognize that such easy open means is optional and the presently disclosed subject matter includes embodiments without such a feature. Once the oxygen-impermeable film is removed, oxygen permeates into the interior of article 5, through upper and/or lower films 15, 20 to contact product 10. The purple-red color of the meat then blooms within the interior of the article to a generally acceptable bright red color when the meat is oxygenated.

As depicted in FIGS. 10*a*-10*e*, blooming can be initiated using a stacking mechanism. In some embodiments, stack 100 can be packaged in oxygen-impermeable overwrap 70 or oxygen-impermeable bag 80. At the time of desired blooming of product 10, overwrap 70 or bag 80 can be removed using simple cutting or unwrapping mechanisms, as discussed above. In embodiments wherein both upper and lower films 15, 20 are oxygen-permeable, the entire stack can then bloom as oxygen permeates through the oxygen-permeable films to contact product 10.

In some embodiments, stack 100 comprises oxygen-impermeable lid film 75 adhered to one or both frames 25, 30, as described above. In such embodiments, at the time of desired blooming of product 10, a user would simply peel away film 75 using means well known in the packaging art. Once the oxygen-impermeable film 75 has been removed, oxygen can then enter the article through oxygen-permeable film 15 and/or 20 to bloom product 10.

As depicted in FIG. 10*b* and described herein above, in some embodiments stack 100 can comprise oxygen-impermeable lid 105 and/or oxygen-impermeable base 90. In these embodiments, simply removing lid 105 and removing a single article from the stack can cause the removed article to bloom. Specifically, in some embodiments, once the article is removed from the stack, oxygen enters the article through oxygen-permeable film 15 and/or 20 to bloom the product. Lid 105 is then replaced on the top of the stack to prevent the remainder of articles in the stack from prematurely blooming. Alternatively, each article can comprise a barrier lid on one side, such that the remainder of the stack is not exposed to the ambient atmosphere.

One of ordinary skill in the art would recognize that more than one of oxygen-impermeable overwrap 70, oxygen-impermeable film 75, and/or oxygen-impermeable bag 80 can be used on a single stack or article.

In order to access product 10 within article 5, a user merely separates films 15, 20 from each other using means well known in the art. For example, a cutting means (knife, scissors, and the like) can be used. Alternatively, films 15, 20 can comprise an easy open means, such as tabs 95 and 110 (as depicted in FIG. 1*a*) that can be pulled apart at a desired time. One of ordinary skill in the art would recognize that any of a number of suitable opening means can be included within the presently disclosed subject matter. One of ordinary skill in the art would also recognize that articles not comprising an easy open means are also within the scope of the presently disclosed subject matter.

VI. Advantages of the Presently Disclosed Subject Matter

Although several advantages of the disclosed system are set forth in detail herein, the list is by no means limiting. Particularly, one of ordinary skill in the art would recognize that there can be several advantages to the disclosed system that are not included herein.

The disclosed article and system teaches the on-demand blooming of a product packaged within an article. Particularly, at any suitable time, blooming of a packaged product can be initiated to preserve shelf-life and to increase customer satisfaction of the overall appearance of the product. Accordingly, the presently disclosed articles are capable of controlling the atmospheric condition of the product contained therein.

It is a specific advantage that in some embodiments, an article for fresh red meat and other products is provided that can be adversely affected by normal atmospheric conditions. The article will prevent exposure to the atmosphere but also is adapted to permit exposure to the atmosphere at an appropriately chosen time.

In addition, the presently disclosed subject matter provides an article for displaying products that is neat, clean, attractive, regular in size and shape, provides good visibility of the product, permits branding and product differentiation, and therefore obviates the deficiencies and disadvantages of prior packaging.

Further, the disclosed article is of a size and shape that is readily stackable and can display the product in either vertical or horizontal orientation. The article also is easy to handle and minimizes labor costs.

In addition, the disclosed article can be constructed from materials that are recyclable (such as, for example, PET) and/or made from recycled materials to reduce the amount of consumer waste.

Further, the package can be displayed vertically by standing on one of the ends, thus allowing the package to fit and be displayed in any of a wide variety of display means.

The package is in a stackable format, thereby saving space for shipping and storage. The stackable format also can eliminate the need for extraneous packaging, such as corrugated boxes and the like.

What is claimed is:

1. An article that enables on-demand blooming of an oxygen-sensitive product within the interior of the article, said article comprising:

a. an oxygen-sensitive product vacuum skin packaged between upper and lower films, wherein at least one of said films is oxygen-permeable;

b. either:

i. upper and lower oxygen-impermeable suspension frames, wherein each frame comprises a plurality of upright side panels, and wherein the edges of said films are maintained in between said upper and lower frames; or ii. a single oxygen-impermeable suspension frame, wherein said frame comprises a plurality of upright side panels, and wherein the edges of said films are attached to said frame;

c. an oxygen-impermeable material wrapped, sealed, or adhered to at least one outer side of said frame or frames, adjacent to said at least one oxygen-permeable film;

wherein said oxygen-impermeable material can be removed on demand to enable blooming of said oxygen-sensitive product.

2. The article of claim 1, wherein said oxygen-sensitive product is fresh red meat.

3. The article of claim 1, wherein said oxygen-sensitive product is vacuum skin packaged between said upper and lower films.

4. The article of claim 1, wherein said oxygen-impermeable material is selected from the group consisting of: an oxygen-impermeable overwrap, an oxygen-impermeable film, an oxygen-impermeable bag, or combinations thereof.

5. The article of claim 1, wherein said article is a modified atmosphere package, consisting of carbon monoxide, carbon dioxide, nitrogen, or mixtures thereof.

6. A method of packaging an oxygen-sensitive product in an article that enables on-demand blooming within the interior of the article, said method comprising:

a. providing an oxygen-sensitive product;

b. vacuum skin packaging said oxygen-sensitive product between upper and lower films, wherein at least one of said films is oxygen-permeable;

c. either:

i. maintaining the edges of said films between upper and lower oxygen-impermeable suspension frames, wherein each frame comprises a plurality of upright side panels; or ii. attaching the edges of said films to a single oxygen-impermeable suspension frame, wherein said frame comprises a plurality of upright side panels;

d. wrapping, sealing, or adhering an oxygen-impermeable material to at least one outer side of said frame or frames, adjacent to said oxygen-permeable film;

wherein said oxygen-impermeable material can be removed on demand to enable blooming within the interior of the article.

7. The method of claim 6, wherein said oxygen-sensitive product is fresh red meat.

8. The method of claim 6, wherein said oxygen-sensitive product is vacuum skin packaged between said upper and lower films.

9. The method of claim 6, wherein said oxygen-impermeable material is selected from the group consisting of: an oxygen-impermeable overwrap, an oxygen-impermeable film, an oxygen-impermeable bag, or combinations thereof.

10. The method of claim 6, further comprising packaging said product in a modified atmosphere consisting of carbon monoxide, carbon dioxide, nitrogen, or mixtures thereof.

11. A method of promoting on-demand blooming of an oxygen-sensitive product, the method comprising the steps of:

a. providing an oxygen-sensitive product;
b. vacuum skin packaging said oxygen-sensitive product between upper and lower films, wherein at least one of said films is oxygen-permeable;
c. either:
   i. maintaining the edges of said films between upper and lower oxygen-impermeable suspension frames, wherein each frame comprises a plurality of upright side panels; or
   ii. attaching the edges of said films to a single oxygen-impermeable suspension frame, wherein said frame comprises a plurality of upright side panels;
d. wrapping, sealing, or adhering an oxygen-impermeable material to at least one outer side of said frame or frames, adjacent to said oxygen-permeable film; wherein said oxygen-impermeable material can be removed on demand to promote blooming of said oxygen-sensitive product.

12. The method of claim 11, wherein said oxygen-sensitive product is fresh red meat.

13. The method of claim 11, wherein said oxygen-sensitive product is vacuum skin packaged between said upper and lower films.

14. The method of claim 11, wherein said oxygen-impermeable material is selected from the group consisting of: an oxygen-impermeable overwrap, an oxygen-impermeable film, an oxygen-impermeable bag, or combinations thereof.

15. The method of claim 11, further comprising packaging said product in a modified atmosphere consisting of carbon monoxide, carbon dioxide, nitrogen, or mixtures thereof.

16. A method of promoting on-demand blooming of an oxygen-sensitive product, the method comprising the steps of:

a. packaging said oxygen-sensitive product in an article by:
   i. providing an oxygen-sensitive product;
   ii. vacuum skin packaging said oxygen-sensitive product between upper and lower films, wherein at least one of said films is oxygen-permeable;
   iii. either:
      1. maintaining the edges of said films between upper and lower oxygen-impermeable suspension frames, wherein each frame comprises a plurality of upright side panels; or
      2. attaching the edges of said films to a single oxygen-impermeable suspension frame, wherein said frame comprises a plurality of upright side panels;
b. stacking a plurality of said articles for a desired time;
c. wrapping, sealing, or adhering an oxygen-impermeable material to at least one outer side of said frame or frames, adjacent to said oxygen-permeable film;
d. promoting blooming of said oxygen-sensitive product by either:
   i. removing said oxygen-impermeable material; or
   ii. removing an article from said stack; or
   iii. both removing said oxygen-impermeable material and removing said article from the stack.

17. The method of claim 16, wherein said oxygen-sensitive product is fresh red meat.

18. The method of claim 16, wherein said oxygen-sensitive product is vacuum skin packaged between said upper and lower films.

19. The method of claim 16, wherein said oxygen-impermeable material is selected from the group consisting of: an oxygen-impermeable overwrap, an oxygen-impermeable film, an oxygen-impermeable bag, an oxygen-impermeable lid, or combinations thereof.

20. The method of claim 16, further comprising packaging said product in a modified atmosphere consisting of carbon monoxide, carbon dioxide, nitrogen, or mixtures thereof.

* * * * *